US010900649B1

(12) United States Patent
Todd

(10) Patent No.: US 10,900,649 B1
(45) Date of Patent: Jan. 26, 2021

(54) EVENT LIGHTING AND AUXILIARY COMPONENTS FOR USE THEREWITH

(71) Applicant: BML Productions, Inc., Secaucus, NJ (US)

(72) Inventor: Eric Todd, Old Tappan, NJ (US)

(73) Assignee: BML PRODUCTIONS, INC., Secaucus, NJ (US)

( * ) Notice: Subject to any disclaimer, the term of this patent is extended or adjusted under 35 U.S.C. 154(b) by 0 days.

(21) Appl. No.: 16/889,935

(22) Filed: Jun. 2, 2020

(51) Int. Cl.
*F21V 21/30* (2006.01)
*F21V 9/40* (2018.01)

(52) U.S. Cl.
CPC ..... *F21V 21/30* (2013.01); *F21V 9/40* (2018.02)

(58) Field of Classification Search
CPC . F21V 21/30; F21V 21/26; F21V 9/40; F21V 14/02; G03B 15/06
See application file for complete search history.

(56) References Cited

U.S. PATENT DOCUMENTS

| | | | | |
|---|---|---|---|---|
| 4,392,187 | A | 7/1983 | Bornhorst | |
| 6,120,164 | A | 9/2000 | Libin et al. | |
| 7,407,304 | B2 * | 8/2008 | Tasson | B60Q 1/2607 362/249.07 |
| RE43,017 | E | 12/2011 | Belliveau | |
| 9,404,641 | B2 | 8/2016 | Belliveau et al. | |
| 9,964,259 | B2 * | 5/2018 | Hudson | G03B 15/02 |
| D857,980 | S * | 8/2019 | Schweid | D26/120 |
| 2010/0320932 | A1 * | 12/2010 | Ma | F21V 23/00 315/294 |
| 2015/0016106 | A1 | 1/2015 | Belliveau et al. | |
| 2016/0356439 | A1 * | 12/2016 | Inskeep | F21L 4/08 |
| 2017/0074489 | A1 | 3/2017 | Junk | |
| 2019/0041048 | A1 | 2/2019 | Martin et al. | |

OTHER PUBLICATIONS

AliExpress.com, "2pcs/Iot Top quality fantastic LED BAY15D P21/5W 1157 or P27/7W 3157 led car light brake light 30smd 5630 5730 tail light" (Printed Sep. 23, 2019).
Elation Professional, EPV762 MH User Manual (pre-2019).
City Theatrical, Barndoors webpage (Printed Jan. 3, 2020 (pre-2020)).
City Theatrical, Beam bender webpage (Printed Jan. 3, 2020 (pre-2020)).
City Theatrical, Wash tophat webpage (Printed Jan. 3, 2020 (pre-2020)).
City Theatrical, Drop-in Irises webpage (Printed Jan. 3, 2020 (pre-2020)).
City Theatrical, Drop-in-boomerang webpage (Printed Jan. 3, 2020 (pre-2020)).
City Theatrical, EFX Plus2 webpage (Printed Jan. 3, 2020 (pre-2020)).
City Theatrical, Image Multiplexer webpage (Printed Jan. 3, 2020 (pre-2020)).
Web page at thtr.382.weebly.com//movement-devices.html (Printed Jan. 3, 2020 (pre-2020)).
U.S. Appl. No. 16/653,404, filed Oct. 15, 2019.
U.S. Appl. No. 16/808,454, filed Mar. 4, 2020.

* cited by examiner

*Primary Examiner* — Anabel Ton
(74) *Attorney, Agent, or Firm* — Weitzman Law Offices, LLC

(57) ABSTRACT

An auxiliary component for use with event lighting is described including a collar, dimensioned to couple to an external surface of an event light and at least one lighting element coupled to the event light via the collar. An event light including an auxiliary component having at least one lighting element is also disclosed.

23 Claims, 21 Drawing Sheets

FIG. 1A
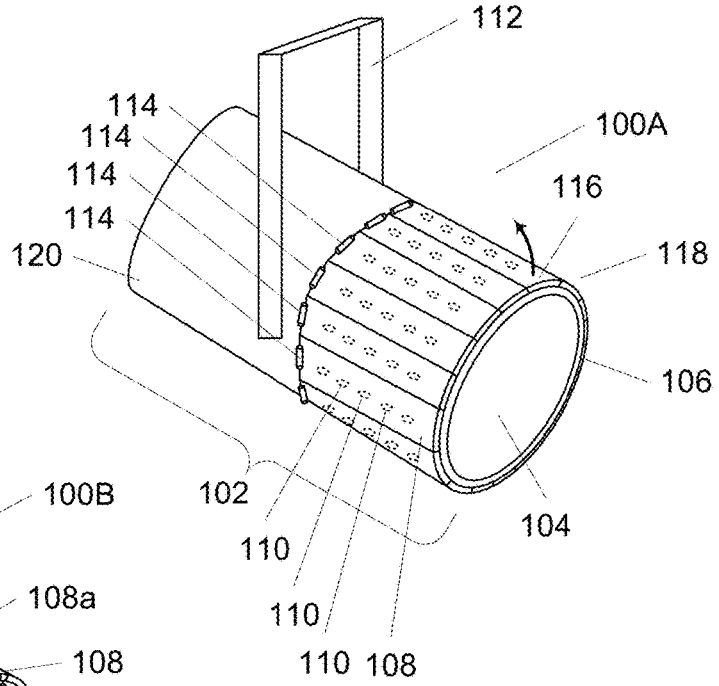
FIG. 1B
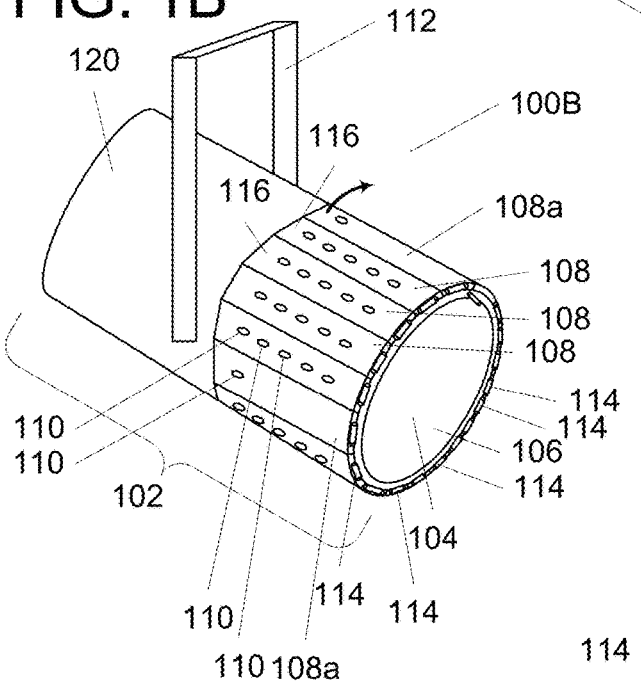
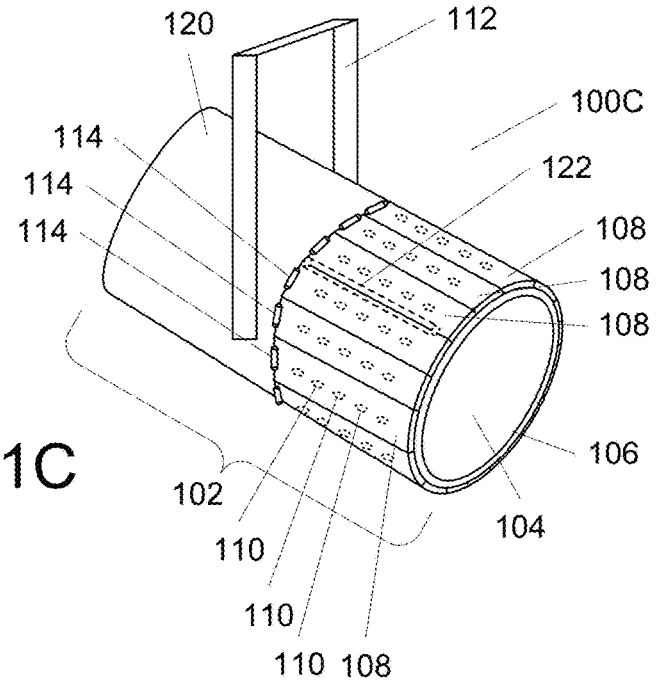
FIG. 1C

FIG. 7
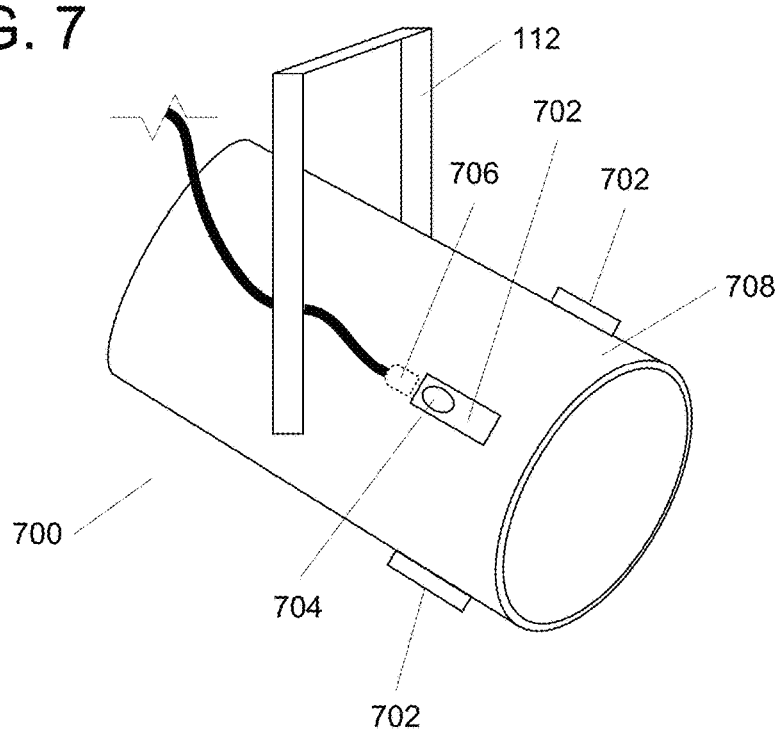
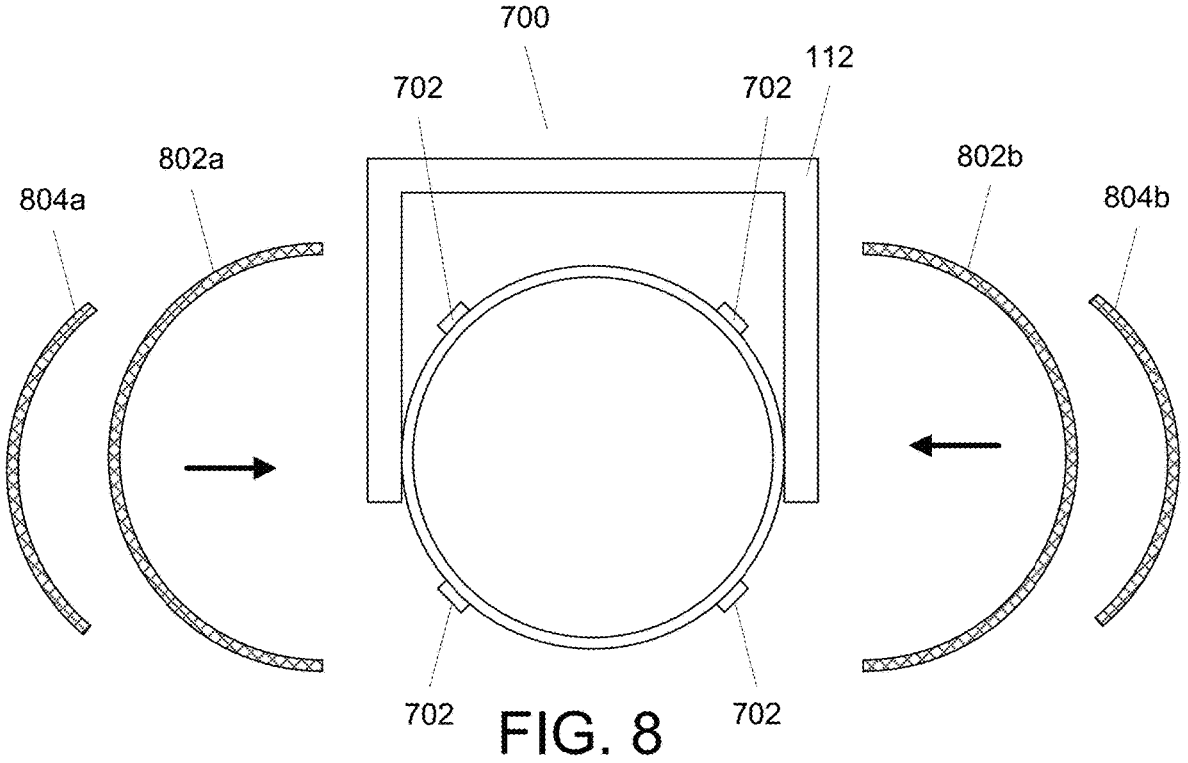
FIG. 8

FIG. 9
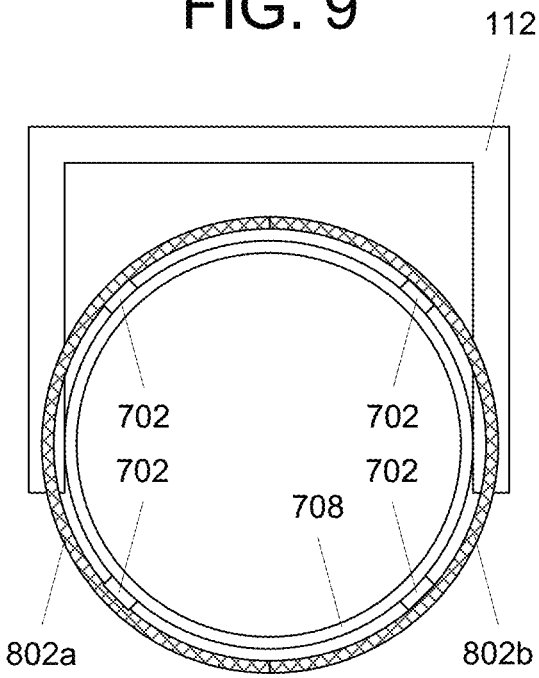
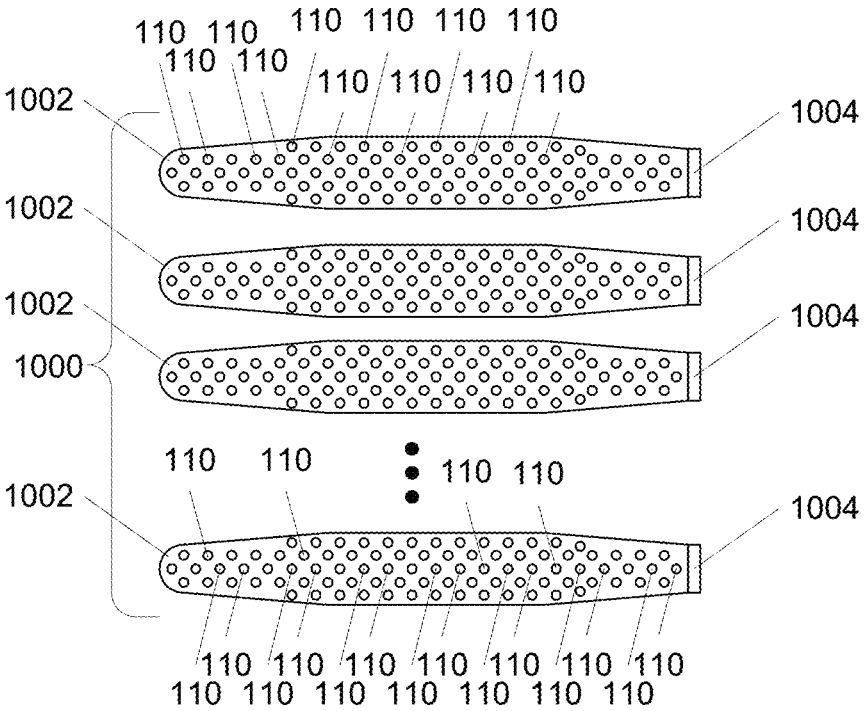
FIG. 10

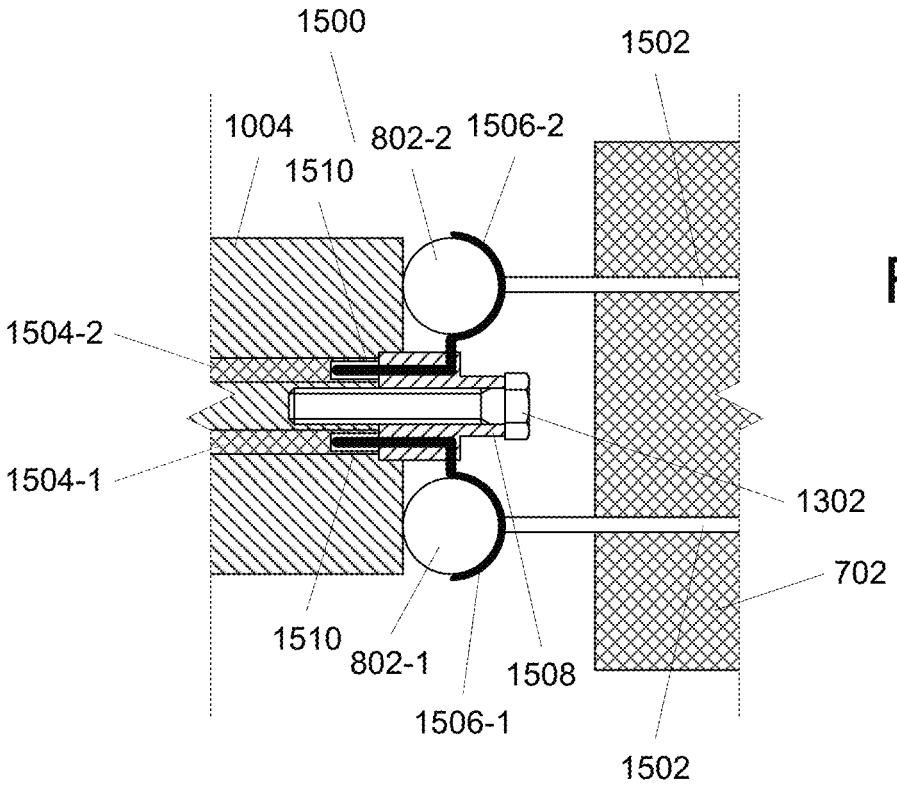
FIG. 15
FIG. 16
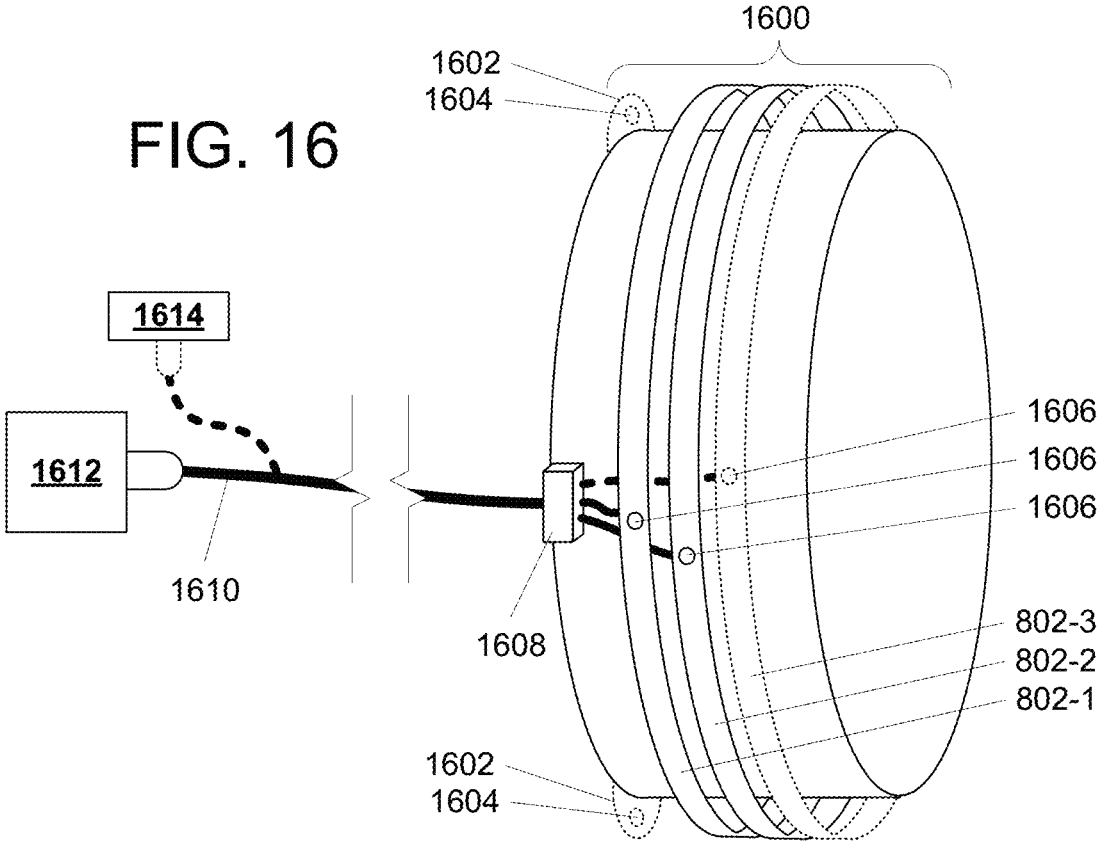

FIG. 24
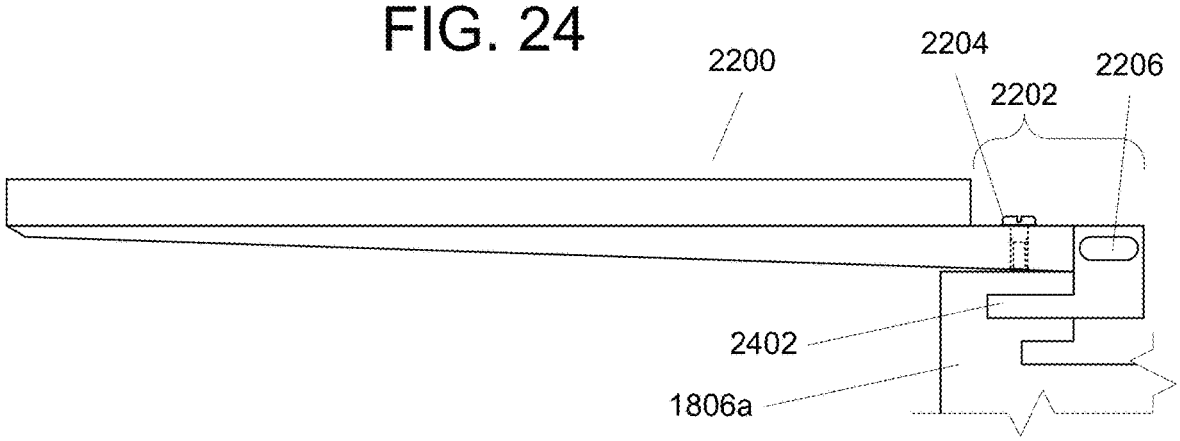
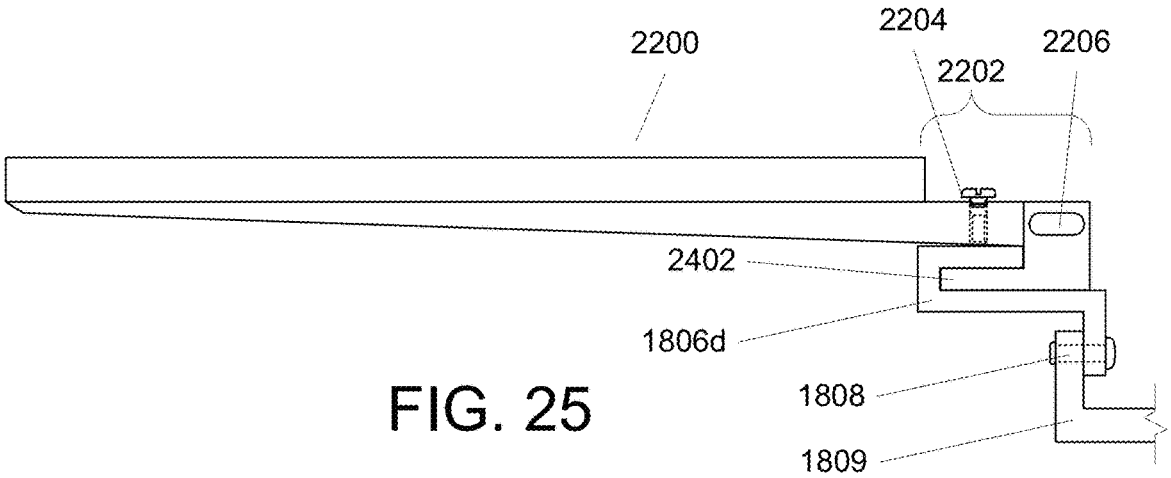
FIG. 25

FIG. 27
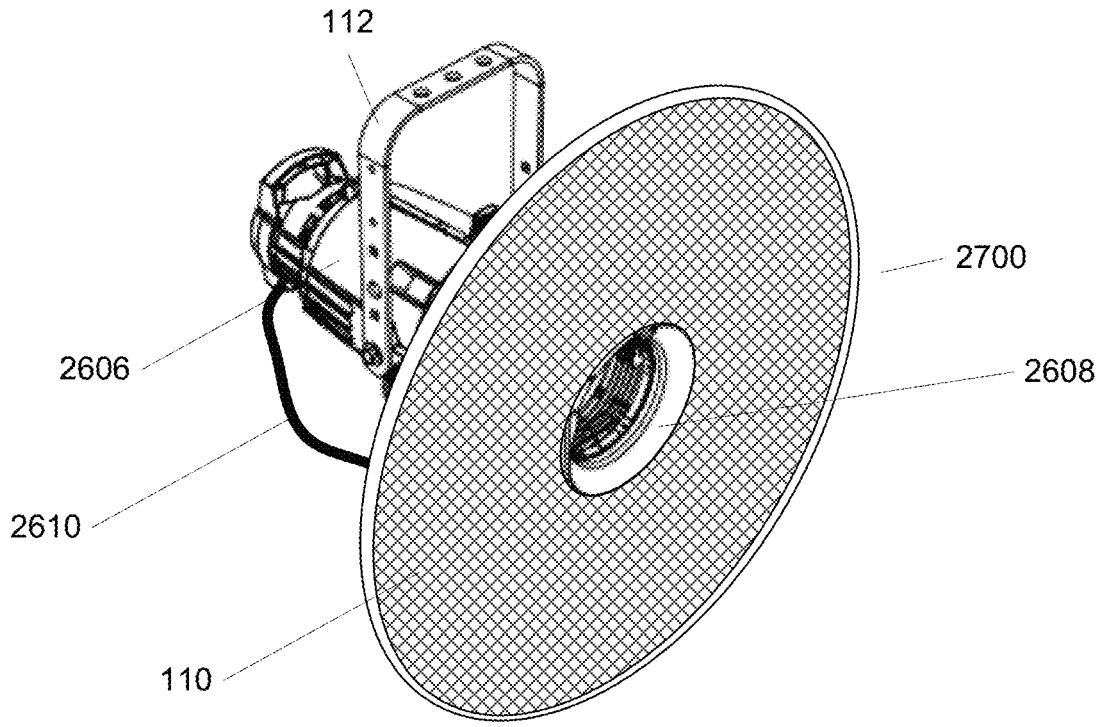
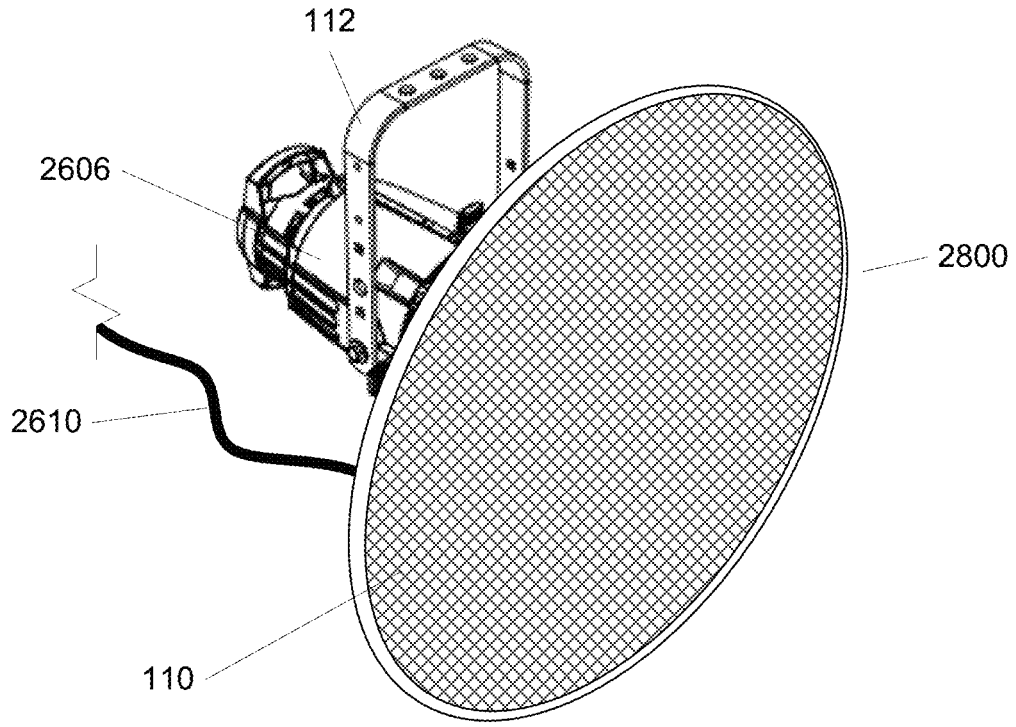
FIG. 28

EVENT LIGHTING AND AUXILIARY COMPONENTS FOR USE THEREWITH

FIELD OF THE INVENTION

This disclosure relates generally to lighting and, more particularly, to lighting equipment used for events.

BACKGROUND

Lighting and light shows are often used in different commercial and non-commercial venues to create, augment, or enhance the mood at an event or venue, such as for live events, television shows, concerts, plays, amusement park lighting, product launches, trade shows, experiential events, public-facing presentations, and the like. In order to do so, light fixtures are often used and, depending upon the specific event and lighting type desired, different size, types, forms or formats of lighting fixtures may be required.

In many cases, the lighting involved is not venue specific or permanently installed at the venue. Rather, the lighting is more commonly transported to a particular venue or location, set up for the event, and thereafter taken down and moved to a new venue for a new event or returned to a lighting rental provider. When moving to a new venue, each lighting fixture must be carefully packed or installed in a portable truss structure or array to transport while preventing damage during travel. Moreover, given the diverse lighting requirements that can be called for, in order to satisfy these diverse needs, a great deal of storage space, and lighting unit specific transporting cases, may be required to accommodate all the different size, types, forms or formats of lighting fixtures. Generally, the larger the lighting fixture, front lens or aperture, the more difficult they are to transport in rolling truss frames or other enclosed or partially enclosed structures.

For permanently installed lighting, it is generally not cost effective to change or upgrade the lighting to accommodate the diverse lighting needs of different events.

SUMMARY

One aspect of this disclosure involves an auxiliary component for use with event lighting having a collar, dimensioned to removably couple to an external surface of an event light; at least one lighting blade, having at least one lighting element thereon, removably coupled to the collar; and a path for power to be transferred from an external power source to the at least one lighting element of the at least one lighting blade.

Another aspect involves an auxiliary component for use with event lighting having a collar, dimensioned to couple to an external surface of an event light, wherein the collar includes a sleeve and at least one lighting blade, having at least one lighting element thereon; and wherein the at least one lighting blade is movable relative to the sleeve such that the at least one lighting blade can moved between a stowed position and a deployed position.

A further aspect involves an event light having a body having an external surface and at least one light source; a yoke coupled to the body; and at least one lighting blade having at least one lighting element associated therewith, the at least one lighting blade being removably coupled to the external surface of the body.

The advantages and features described herein are a few of the many advantages and features available from the representative examples presented herein and are presented only to assist in understanding the invention. It should be understood that they are not to be considered as limitations on the scope defined by the claims, or limitations on equivalents to any part of the claims. For instance, some of the advantages or aspects described herein are mutually contradictory, in that they cannot be simultaneously present in a single implementation. Similarly, some advantages may be applicable to one described aspect, and inapplicable to others. Thus, features and advantages described should not be considered dispositive in determining equivalence. Additional features and advantages arising from the teachings herein will become apparent from the following description, from the drawings, and/or from the claims.

BRIEF DESCRIPTION OF THE DRAWINGS

This disclosure is further described in the detailed description that follows, with reference to the drawings, in which:

FIG. 1A illustrates, in simplified form, a perspective view of one example implementation of an event light as described herein;

FIG. 1B illustrates, in simplified form, a perspective view of another, alternative, example implementation of a event light;

FIG. 1C illustrates, in simplified form, a perspective view of yet another example implementation of a event light;

FIG. 7 illustrates, in simplified form, a conventional event light that has been retrofitted with components that allow for use of, for example, a blade collar as described herein, or further alternative approaches for deployment of one or more blades;

FIG. 8 illustrates, in simplified form, a front view of the event light of FIG. 7;

FIG. 9 illustrates, in simplified form, the event light of FIGS. 7-8 after attachment of the arc-shaped supports of FIG. 8;

FIG. 10 illustrates, in simplified form, a set of alternative lighting blades that contain multiple individual lighting elements along their length;

FIGS. 12-15 illustrate, in simplified form, different representative examples of just a few of the myriad possibilities that can be used to provide mechanical and/or electrical connections between a lighting blade and event light in accordance with the teachings herein;

FIG. 16 illustrates, in simplified form, another example variant collar for use with an entirely conventional event light without requiring any modification of the event light itself;

FIG. 24 illustrates, in simplified form, a side view of the example lighting blade of FIG. 22 coupled directly to an example support of one event light of FIG. 18;

FIG. 25 illustrates, in simplified form, a side view of the example lighting blade of FIG. 22 coupled directly to an example support of the other event light of FIG. 18;

FIG. 27 illustrates, in simplified form, yet another example alternative variant of an auxiliary component coupled to the conventional event light of FIG. 26; and FIG. 28 illustrates, in simplified form, yet another example alternative variant of an auxiliary component coupled to the conventional event light of FIG. 26.

DETAILED DESCRIPTION

Figure 2A:
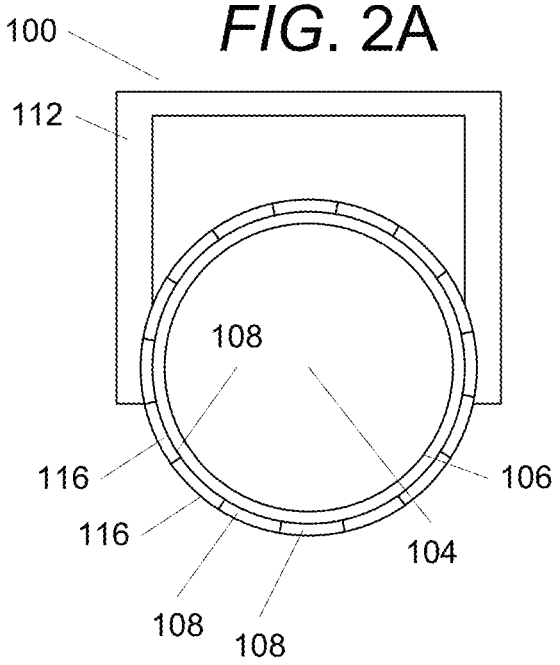
FIG. 2A illustrates, in simplified form, an end-on view of the front of the event light of FIG. 1A with the lighting blades in their "stowed" position.

Fixed lights (e.g., spot lights, wash lights, etc.), moving head profile lights, and hybrids of the foregoing (all individually and collectively generically referred to herein as "event lighting" or "event lights"), are utilized to project light from a light source to enhance performances, live events, television shows, concerts, plays, amusement park lighting, and the like, innovation is key. Among users of such event lights, once something new and improved comes out, those in the industry often race to both acquire the newest technology and often sell off older equipment to: fund the purchase of the newest technology, free up storage space, or simply to keep only the most current technology on hand. New event lights come out all year long and it is extremely cost prohibitive to try and keep up by purchasing newer, costly, event lights only to find that, shortly thereafter, a better or different fixture comes out that becomes more popular than what was purchased. It is difficult even for the largest of rental companies to keep up with the ongoing evolution of event lights before their existing fixtures are even paid for. Thus, if a new event light is introduced that would produce certain special/customized lighting effects that their current lighting could not do there is no choice but to purchase an entirely new event light. Moreover, event lights come in different sizes, so if greater light output is temporarily needed beyond what a selected event light can provide, it must be replaced by a larger one or one with a higher output or different output of the same or different size. Likewise, if a lighting effect is desired, but cannot be produced by a event light currently in place, the existing event light must be swapped for one that can provide that lighting effect, or it must be foregone. Swapping these types of event lights is time consuming and costly. In addition, larger event lights take up more space during storage and transit, and space is often a scarce commodity in this regard.

In contrast, by using the teachings herein with such event lights, in many cases, the need to swap event lights to provide a larger light output or different lighting effect can be avoided. Moreover, in some cases, larger or different lighting effects can be provided using an adjunct to an existing (e.g., prior art) event light. In some further cases, significantly larger light output and/or lighting effects can be provided with only a minimal increase in required space during transport.

One such approach uses deployable folding blades that typically either contain one or more lighting elements or act as supporting structures to which one or more lighting elements can be attached. In normal usage, the event light is essentially the same size and shape of a conventional event light of the prior art, i.e., it may be the same size or nominally bigger. If there is a need for greater lighting capacity and/or a different lighting effect, some or all of the blades can be deployed, thereby obviating the need to swap the fixture for another one or to do without.

FIG. 1A illustrates, in simplified form, a perspective view of one example implementation of an event light 100A incorporating such an approach.

As shown in FIG. 1A, the event light 100A is made up of a body 102, which houses, for example, the electrical components needed to power the main lighting unit 104, which may be covered by one or more lens(es) 106.

Advantageously, the event light also includes multiple lighting blades 108 which individually contain lighting elements 110, which (depending upon implementation) may be a single light (e.g., bulbs, a light emitting diode (LED), a semiconductor laser, a halogen or other high intensity light, etc.), a group of LEDs (e.g., R-G-B-W LEDs for providing changing colors) that are treated as a single light, or an array of multiple lights or LEDs. Depending upon the particular implementation, the lighting blades 108 can be of any desired size or shape, limited only by available space and/or power, the size and/or shape of any particular lighting blade consistent with the teachings herein being a matter of design choice. In addition, as used herein, the term "lighting blade" is intended to mean and encompass any array or assembly, of any shape (e.g., linear, arc, circular, freeform, square, rectangular, quadrilateral, angled, lozenge, cylindrical, toroidal, cubic, pyramidal, conic, etc.) containing one or more lighting elements that can attach to an event light in a manner consistent with the teachings herein. It is to also be understood that the lighting elements 110 need not all be located on the same surface of a lighting blade constructed according to the teachings herein. Depending upon the particular implementation, lighting elements 110 can be located on more than one surface of a lighting blade.

At least one frame or yoke 112 is coupled to the body 102 so that it can be attached to a supporting structure, such as, for example, a truss, gantry, beam, stage, wall or ceiling, either directly or, via a base (if the frame or yoke is intended to be movable relative to the base during use).

A hinge 114, or other suitable structure, is coupled to each lighting blade 108, and allows for a terminal end 116 of the lighting blades 108 to pivot outwards from the rest of the event light 100 (as shown by the arrow), for example, to a fixed angle of, for example, up to 90 degrees, although greater or lesser angles can also or alternatively be provided for. Depending upon the particular implementation, a single locking position can be provided and the pivoting movement of a lighting blade 108 can be unimpeded until it reaches the locking position, at which point it will lock into place until released. Alternatively, one or more intermediate fixed locking positions can be provided, or, for some implementations, the lighting blade can be locked into place anywhere within its sweep. There are numerous known ways for releasably locking two components together ranging from, for light components, hook and loop-type fasteners, to, for heavier components, locking screws, ratcheting catches, cables, etc, and the selection of the particular one to be used for a given implementation is not germane to understanding the teachings herein, so, suffice it to say that any appropriate mechanism that will maintain a deployed lighting blade in place, post deployment, can be used.

In addition, in FIG. 1A, the lighting blades 108 each incorporate internal wiring that allows them to at least obtain power and, may include, internal control and/or data wiring or a receiver, so that the lighting element(s) 110 on a blade can be turned on or off (or color changed, if possible with the particular implementation) independent of the main lighting unit 104. The inclusion of internal wiring and/or other components (e.g., a wireless receiver, processor, fan, heat sink(s), etc.) in any lighting blades described herein is optional and will be a function of the particular design and its requirements.

As shown in FIG. 1A, when the lighting blades 108 are in a closed position, the lighting elements 110 will be hidden. In addition, when deployed, the lighting blades 108 will be recessed from the forward-most portion of the event light 100A.

In some cases, having the lighting blades 108 recessed from the forward-most portion of an event light (such as shown in FIG. 1A) may be undesirable. However, that placement is not a requirement.

FIG. 1B illustrates, in simplified form, a perspective view of another, alternative, example implementation of a event light 100B that avoids the recessed positioning issue identified with respect to FIG. 1A.

As shown in FIG. 1B, the lighting blades of FIG. 1B are coupled at or near the forward-most portion of the event light 100B and the lighting elements 110 are outward facing when the lighting blades 108 are in a closed position. In addition, some of the lighting blades 108 have multiple lighting elements, whereas other lighting blades 108*a* have only a single lighting element. It is to be understood that the number of individual lighting elements 110 that may be present on a specific lighting blade 108, 108*a* may be the same as all of the other lighting blades, or may differ from one or more of the lighting blade(s), for example, in order to allow for creation of different lighting effects when in use.

As can now be understood, with the configuration of FIG. 1B, when the terminal ends 116 of the lighting blades 108 to pivot outwards from the rest of the event light 100 (as shown by the arrow), the lighting blades 108 will be located at or near the forward-most portion of the event light 100B.

FIG. 1C illustrates, in simplified form, a perspective view of yet another example implementation of a event light 100C that is similar to the event light of FIG. 1A when closed. However, with this configuration, the event light 100C of FIG. 1C includes a track 122 between the lighting blades and a portion of the body 102 of the event light 100C underneath the closed lighting blades 108. With this configuration, movement of the end of the lighting blades 108 opposite the terminal end 116 in the direction of the forward-most portion of an event light 100C will cause the terminal ends 116 to swing outwards as in FIG. 1A, but the end result will be that, when fully deployed, the lighting blades 108 will be located at or near the forward-most portion of the event light 100. Depending upon the particular implementation, the deployment based upon movement can be accomplished using any appropriate approach, for example, one or more gears, wires, screws, etc., the particular mechanism to be used being an implementation choice.

FIG. 2A illustrates, in simplified form, an end-on view of the front of the event light 100A of FIG. 1A with the lighting blades in their "stowed" position. As can be seen, when the lighting blades 108 are stowed, the peripheral dimension of the overall event light 100 is, typically, only nominally larger than the peripheral dimension of the forward portion 118 of the body 102 housing the main lighting unit 104, and, in some cases, when the lighting blades 108 are stowed, the peripheral dimension of the part of the event light 100A with the lighting blades 108 can be substantially flush with the rear portion 120 of the body 102.

Figure 2B:
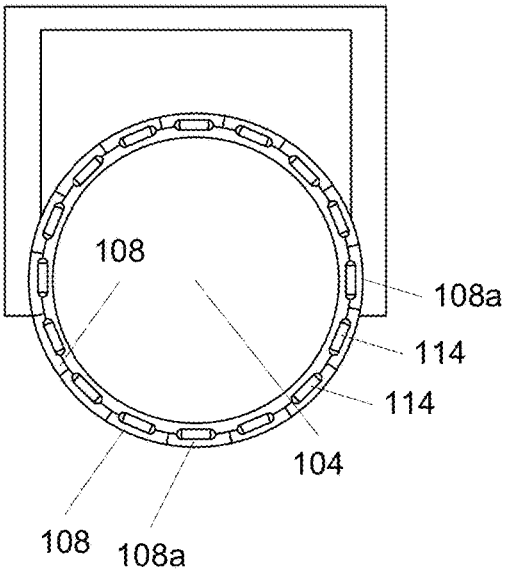
FIG. 2B illustrates, in simplified form, an end-on view of the front of the event light of FIG. 1B with the lighting blades in their "stowed" position.

FIG. 2B illustrates, in simplified form, an end-on view of the front of the event light 100B of FIG. 1B with the lighting blades in their "stowed" position.

Figure 3A:
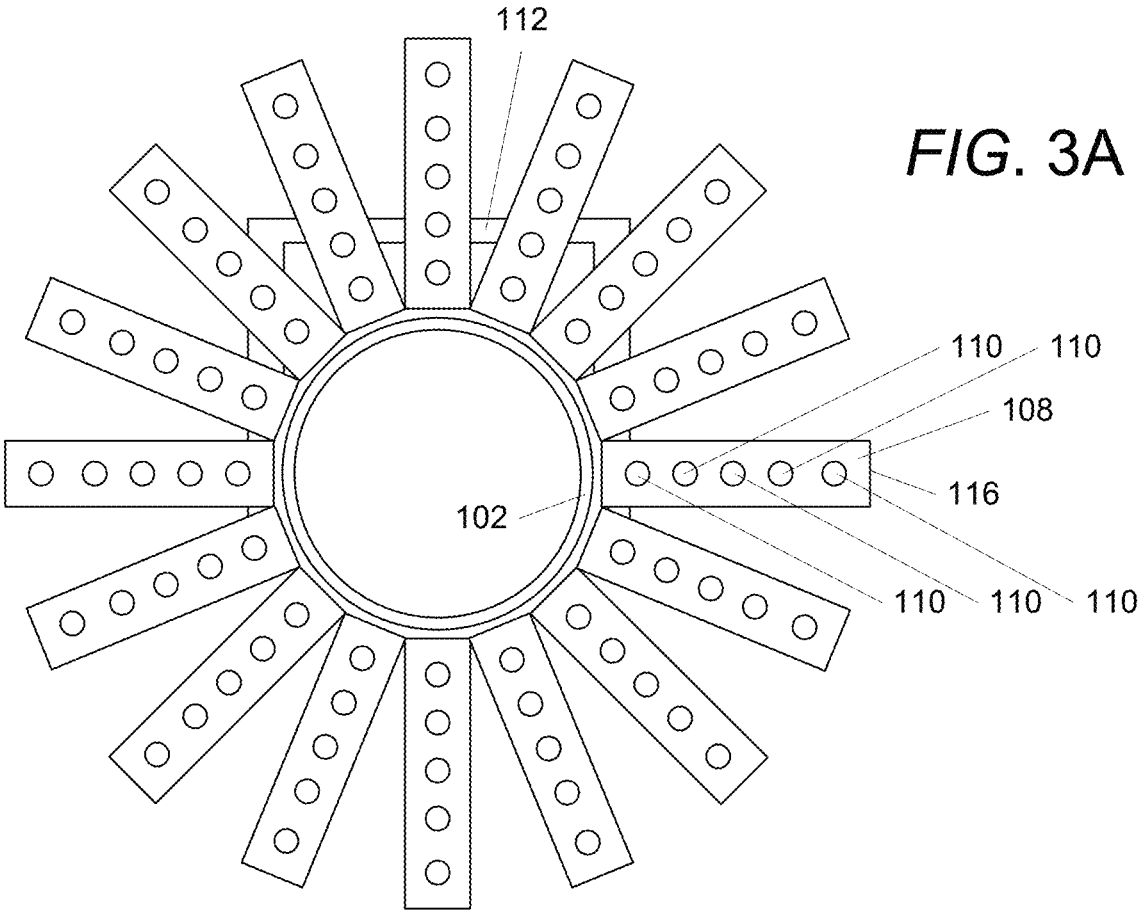
FIG. 3A illustrates, in simplified form, the end-on view of the front of the event light of FIG. 2A after the lighting blades 108 have been deployed (i.e., pivoted outwards) for use.

FIG. 3A illustrates, in simplified form, the end-on view of the front of the event light 100A of FIG. 2A after the lighting blades 108 have been deployed (i.e., pivoted outwards) for use. Note here that, as shown, the individual lighting blades 108 all have an identical configuration of multiple lighting elements 110. However, this is not a requirement for lighting blades, a given lighting blade 108 can have one or more lighting elements 110 and/or can have a configuration of lighting element(s) 110 that is the same as one or more other lighting blades 108, or it can be different from one or more of the other lighting blades 108 of the event light.

Figure 3B:
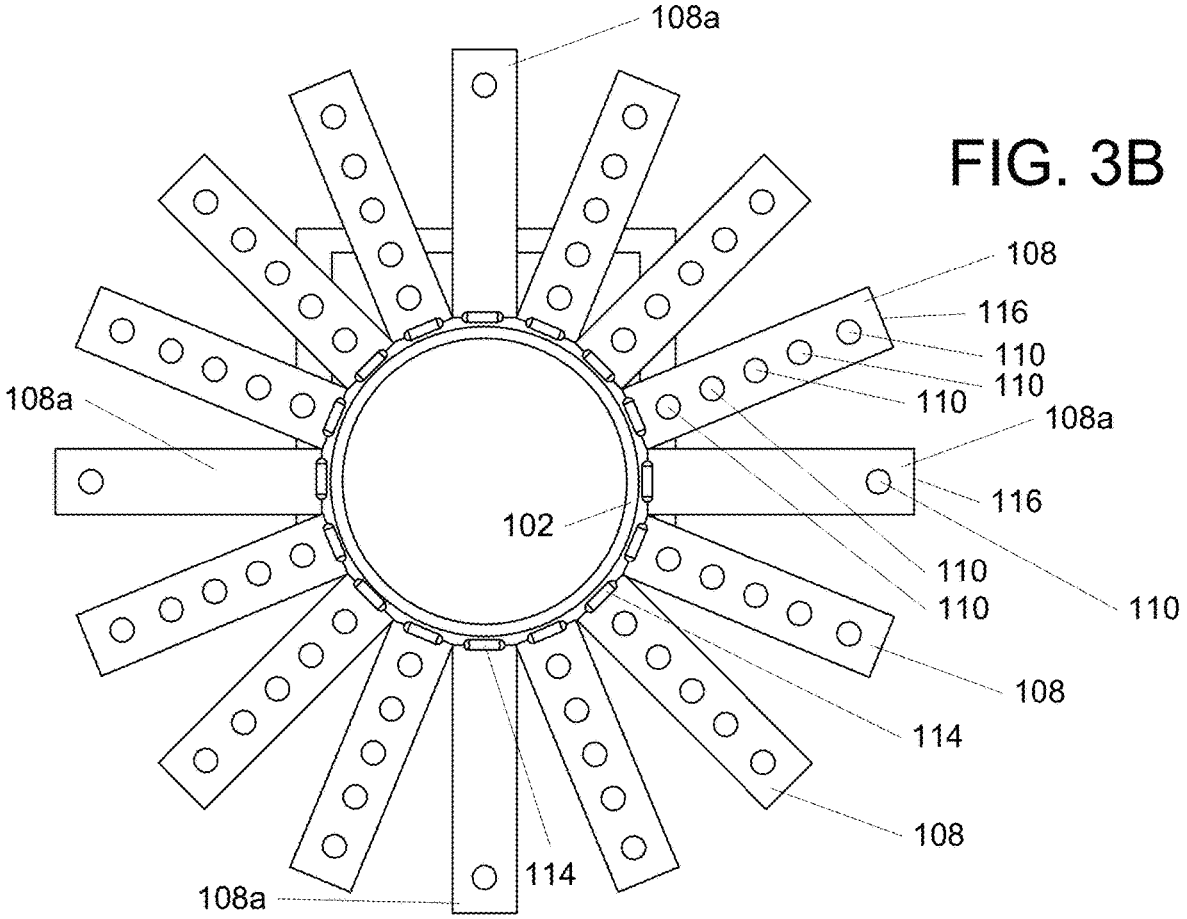
FIG. 3B illustrates, in simplified form, the end-on view of the front of the event light of FIG. 2B after the lighting blades 108 have been deployed (i.e., pivoted outwards) for use.

FIG. 3B illustrates, in simplified form, the end-on view of the front of the event light 100B of FIG. 2B after the lighting blades 108 have been deployed (i.e., pivoted outwards) for use. As shown, some lighting blades 108*a* have only one lighting elements 110, whereas other lighting blades 108 have multiple lighting elements 110 thereon.

As can now be seen in FIGS. 3A and 3B, the overall extent of the event light 100A, 100B with their respective lighting blades deployed is much larger, allowing each to provide, for example, greater light output, or different lighting effects using the lighting elements 110 of the lighting blades 108, 108*a*.

Moreover, when each of the event light 100A, 100B, 100C of FIGS. 1-3 must be transported to a new location, the respective blades 108, 108*a* can be stowed against the body 102 to render the event light more compact for packing and/or travel.

In all of FIGS. 1A-1C, 2A-2B, 3A-3B, the lighting blades 108 were an integral part of the overall event light 100 (e.g., the event light was manufactured with the lighting blades as a unit). However, this is not a requirement. Some implementations allow for lighting blades to be attached to and/or removed from a given event light as a unit so that the event light can be used in a conventional manner if desired, without having to transport lighting blades if they will not be needed for a given situation.

Figure 4A:
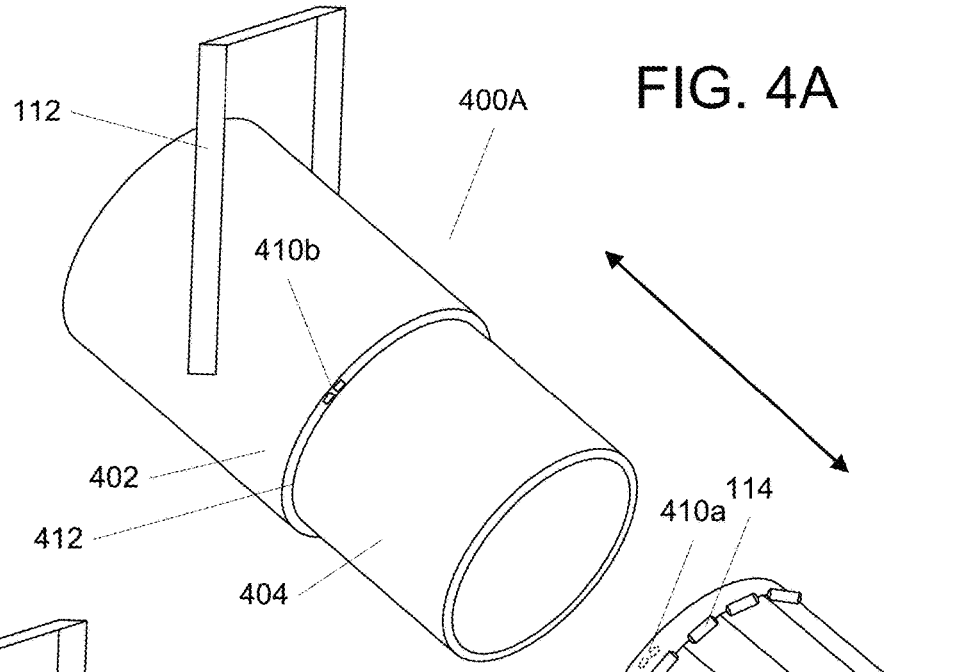
FIG. 4A illustrates, in simplified form, an event light that can removably receive a blade collar on a periphery of a portion of the event light.

FIG. 4A illustrates, in simplified form, an event light 400A that can removably receive a blade collar 402 on a periphery of a portion 404 of the event light 400A. As shown, the blade collar 402 is made up of a sleeve 406 that is dimensioned to slide over the periphery of the forward portion 404 of the event light 400. A series of lighting blades 408 each containing one or more lighting elements 110, as shown an LED array, are physically coupled to the sleeve 406. The sleeve 406 also contains at least wiring to allow power to get to the lighting blades 408 for use by the lighting element 110. As with FIGS. 1A-1C, 2A-2B, 3A-3B, the lighting blades 408 are coupled to the sleeve 406, for example using hinges or some other mechanism, such that they can be pivoted (individually or collectively) outward and maintained in place for use. In addition, as shown, the sleeve 406 includes one or more connectors 410*a* via which power (and optionally, control signals and/or data, if not provided wirelessly) can be supplied to the lighting blades 408 from the event light 400 via a matingly corresponding connector 410*b*.

Finally, as shown, the event light of FIG. 4A makes use of a shelf 412 that is part of the overall outer shape of the event light 400 to act as a depth stop for the sleeve 406. Thus, to all outward appearances, without the sleeve 406, the event light 400 looks like, or much like, a conventional event light, perhaps except for the connector 410*b*, which may be hidden by a cap (not shown). As shown in FIG. 4A, when the lighting blades 408 are deployed, they will be recessed from the front of the event light 400A in a manner similar to FIG. 1A.

Figure 4B:
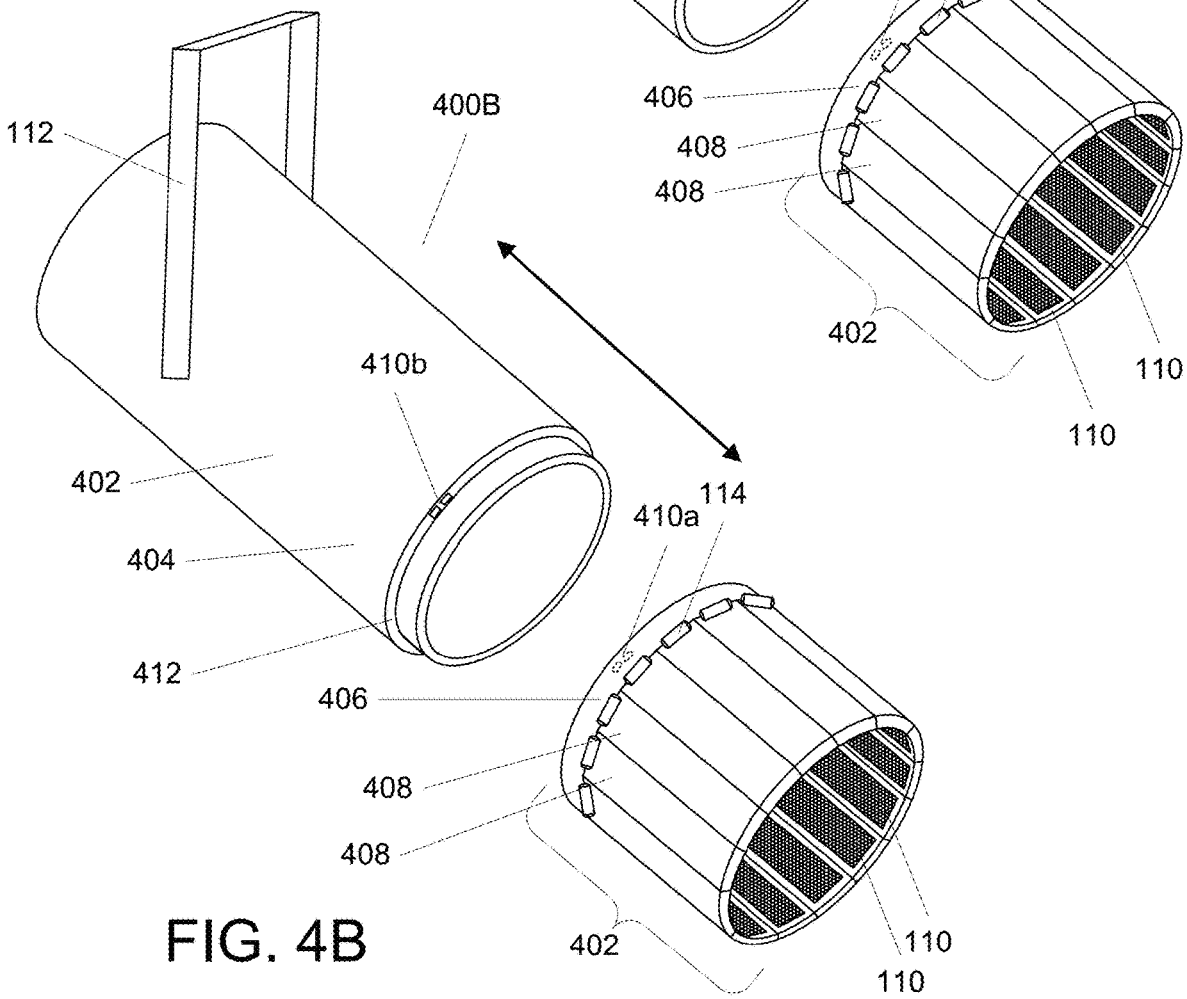
FIG. 4B illustrates, in simplified form, an alternative event light that can removably receive a blade collar on a periphery of a portion 404 of the event light.

FIG. 4B illustrates, in simplified form, an alternative event light 400B that can removably receive a blade collar 402 on a periphery of a portion 404 of the event light 400B in a manner similar to the event light 400A of FIG. 4A, except that the shelf 412 is located at or near the front to the event light 400B so that, when the sleeve 406 of the blade collar 402 is attached and the lighting blades 408 are deployed, they will be positioned at or near the front of the event light 400B similar to FIGS. 1B-1C.

Figure 4C:
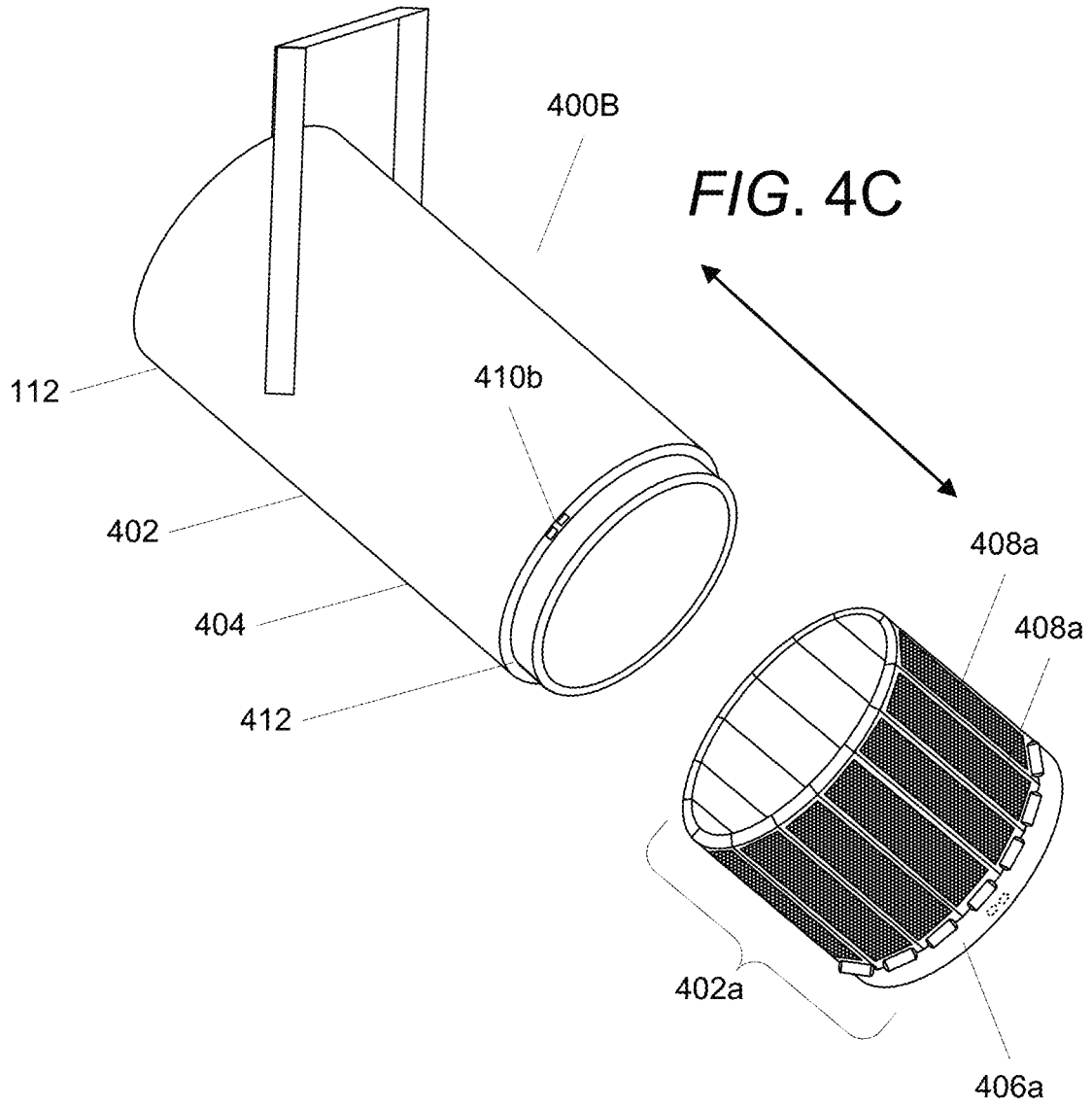
FIG. 4C illustrates, in simplified form, an alternative blade collar that can be used with the event light of FIG. 4B.

FIG. 4C illustrates, in simplified form, an alternative blade collar 402*a* that can be used with the event light 400B of FIG. 4B. As shown, the lighting elements 110 on the lighting blades 408*a* of the blade collar 402*a* of FIG. 4C are outward facing. In addition the internal diameter formed by the stowed lighting blades 408*a* is slightly larger than the outer diameter of the portion 404 of the event light 400B so that, during coupling of the blade collar 402*a* to the event light 400B, the lighting blades 408*a* can slide over the portion 404 until the sleeve 406*a* engages the shelf 412 of the event light 400B.

At this point it should be noted that, for simplicity and understanding, the sleeve 406*a* is shown as being, at least in part, beyond the lighting blades 408*a*. It is to be understood that, for particular implementations however, the sleeve 406*a* could be entirely within the internal diameter formed by the lighting blades 408*a*, in which case it would not necessarily be visible in a figure such as FIG. 4C.

Still further, depending upon the particular implementation, a blade collar 402 could have different numbers of lighting blades, ranging from a single lighting blade to many lighting blades, and such multiple lighting blades need not cover the entire periphery of the sleeve 406.

Advantageously, blade collars constructed as described herein can further be used to retrofit for, or as an adjunct to, a conventional event light.

Figure 5A:
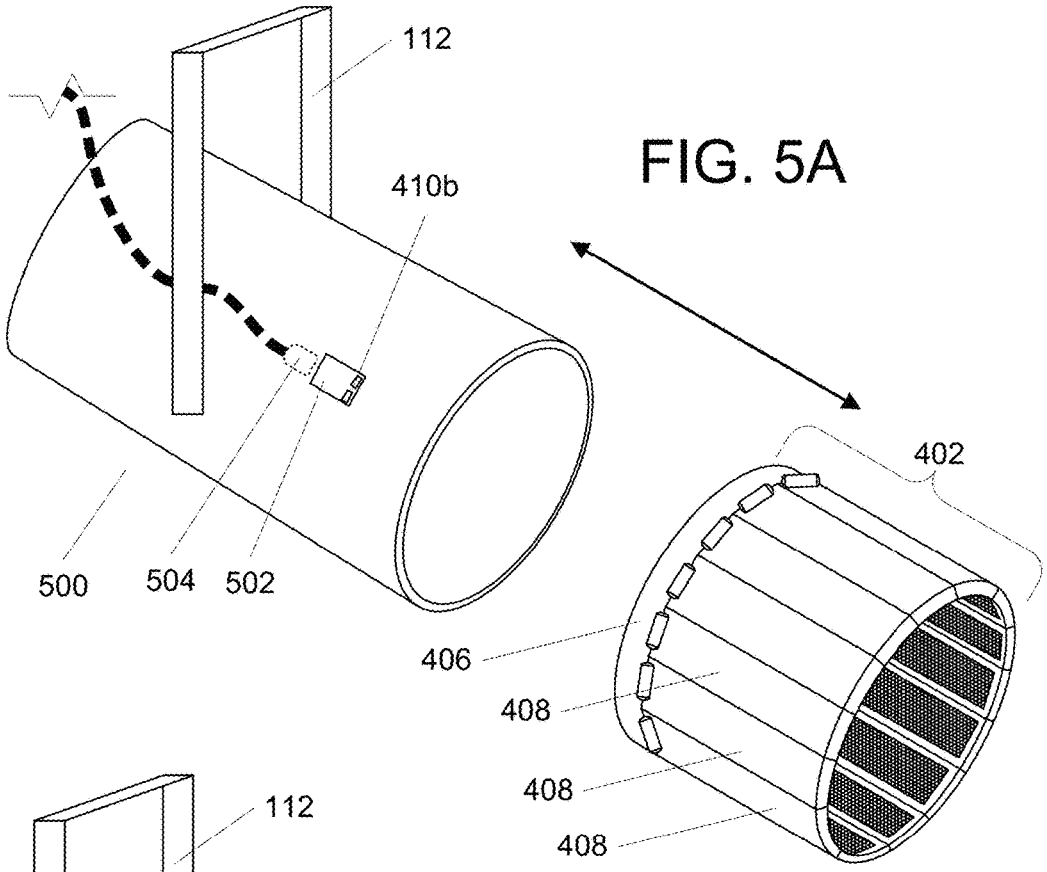
FIGS. 5A-5B illustrate, in simplified form, an event light with which a blade collar such as shown in FIG. 4A, 4B can be used.
Figure 5B:
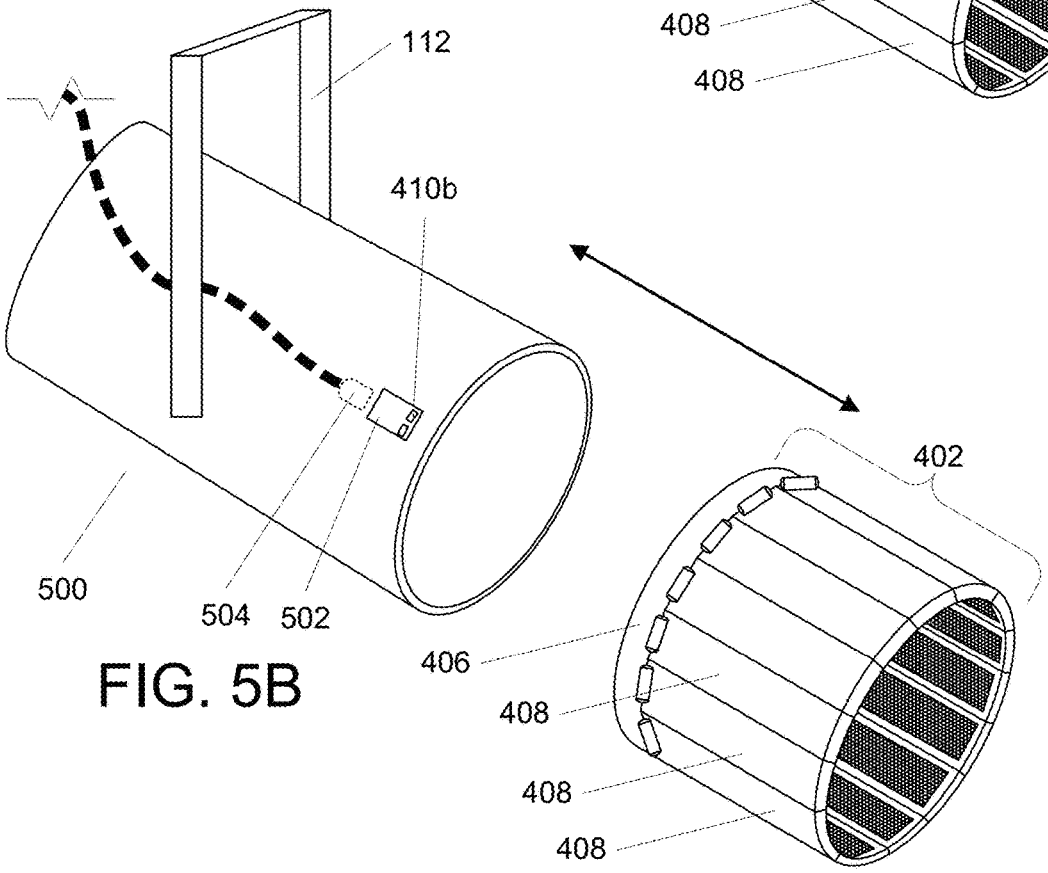

FIGS. 5A-5B illustrate, in simplified form, an event light 500 with which a blade collar 402 such as shown in FIG. 4A, 4B can be used. In some implementations, the event light 500 will be a conventional event light 500 to which an external block 502 is added (for example, using glue or a fastener) that acts as, or includes, one or more of: a depth stop for the sleeve 406, a mating connector 410*b* for the connector 410*a* of the sleeve 406, a conduit through which power can be supplied to the sleeve 406, either, for some implementations, via internal wiring from the event light 500 itself (where the stop or plug may simply be a power outlet on the surface of the event light) or for other implementations, from an external (to the lighting head of the event light) power source (e.g., a generator, battery (internal or external), electrical outlet, outlet on the yoke or base of a movable event light, etc.) via a plug 504, or optionally, in other implementations, via either of the two at the user's choice.

FIG. 5B differs from FIG. 5A only in that the block 502 is positioned farther back on the event light 500 of FIG. 5A than in FIG. 5B. This is to illustrate the versatility in positioning that may be available for some implementations.

Further alternative implementations need not require any modification to the event light (i.e., so that an entirely prior art event light can be used with the sleeve) where, for example, the sleeve 406 includes set screws or other suitable mechanical components that are usable to adhere the sleeve 406 to the event light 500 or the sleeve 406 is constructed so that it can be permanently affixed to the event light, for example, using an epoxy or other glue, the particular components that can be used for adhering the a sleeve to an event light being any component(s)/material(s) that can sufficiently strongly (and, in some cases, removably) reliably adhere the sleeve to a peripheral portion of the event light.

It should further be understood here that, for simplicity, the event lights herein are, and will be, shown as having a round peripheral shape, however, it is understood that other housing shapes, at least near the forward portion, are used in conventional fixtures such as square, square with rounded corners, oval, as well as housings that are longitudinally tapered, etc. Advantageously, according to the approaches described herein, to be used with such fixtures, a blade collar and/or sleeve need only conform to that shape (or have an internal periphery that is larger than the external periphery of the event light with which it will be used) of an extent necessary to allow the sleeve to slide over the forward portion a sufficient distance such that, if not deployed, the blades will not significantly adversely affect the normal output of the event light such that it is unsuitable for its purpose and/or the blades have sufficient space to be deployed as desired.

Finally, as can be seen in all of FIGS. 4A-4C, 5A-5B, the lighting blades 408 are all shown in their "stowed" position.

Figure 6:
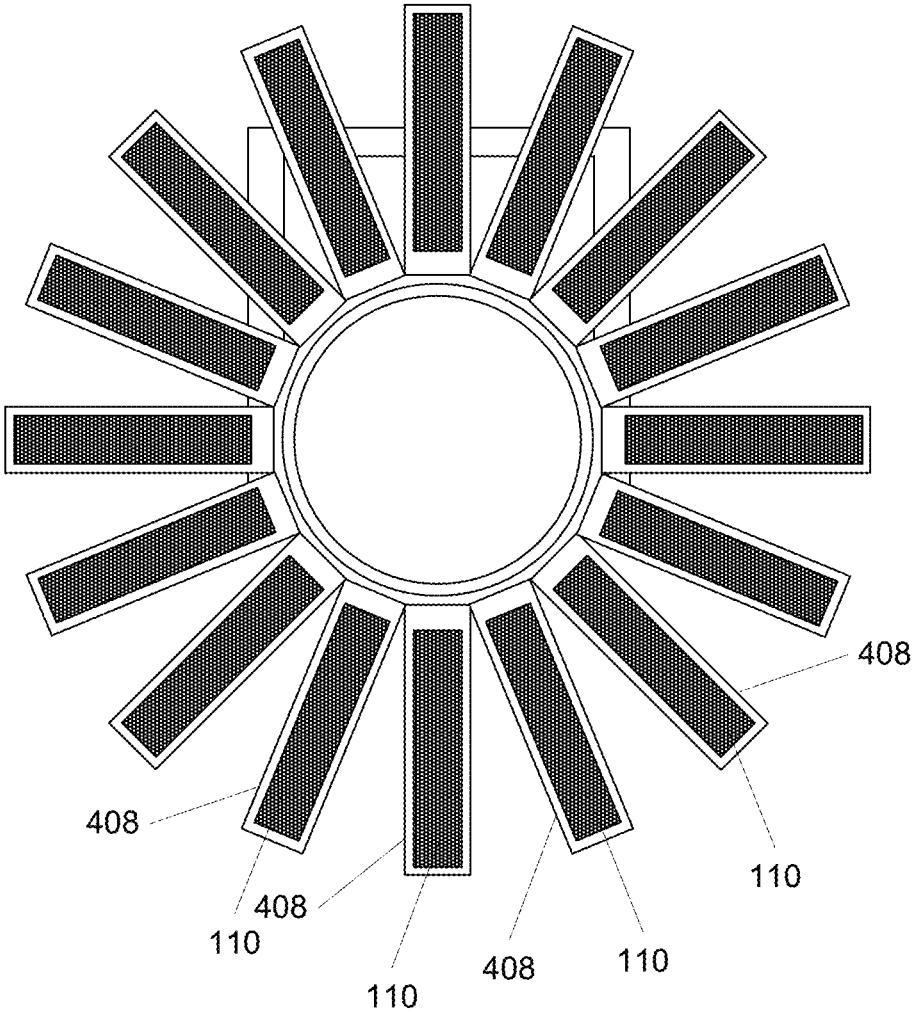
FIG. 6 illustrates, in simplified form, the end-on view of the front of the event lights of FIGS. 4-5 after the lighting blades have been deployed.

FIG. 6 illustrates, in simplified form, the end-on view of the front of the event lights 400A, 400B, 500 of FIGS. 4A-4C, 5A-5B after the lighting blades 408 have been deployed.

Alternatively, in lieu of deployable lighting blades, a blade collar could, of course, have lighting blades that are permanently always attached to its sleeve in what is shown in FIG. 6 as the "deployed" position.

A further advantage of some implementations of the teachings herein is that they allow for retrofitting of existing event lights with still other variants using the most minimal of modifications.

FIG. 7 illustrates, in simplified form, a conventional event light 700 that has been retrofitted with components that allow for use of, for example, a blade collar 402 as described herein, or further alternative approaches for deployment of one or more blades. As shown in FIG. 7, the event light 700 has had attached to it one or more standoffs 702, which, depending upon the implementation, can be removably attached to the event light 700 itself using, for example, screws, bolts, etc., or can be more permanently attached using, for example, epoxy, welds, rivets, etc. The standoff(s) 702, can span any portion of the periphery of the event light 700 depending upon the particular implementation.

One or more of the standoffs 702 are constructed so that power can be provided from an external source (not shown) to and/or through the standoff 702, depending upon implementation, via, for example, a wire 704 that is directly connected to terminals on the standoff, via a removable plug/receptacle 706 connection that matingly corresponds to a component of the standoff 702, or via a passage through which a wire can pass.

In general, the interface between the lighting head 708 (i.e., forward portion of the event light 700) and the standoff 702 can be electrically insulated (either based upon the material of the lighting head housing, the standoff material at the interface, or an insulator interposed in between the two) so that current cannot undesirably be passed to the lighting head 708 (e.g., its external housing and/or internal components).

In some implementations, the standoffs 702 merely act as depth stops for a lighting collar 402 constructed according to the teachings herein. In other implementations, the standoffs 702 act as a physical support (and in some cases provide a conduit for electrical power) for one or more individually attachable blades.

FIG. 8 illustrates, in simplified form, a front view of the event light 700 of FIG. 7. As shown in FIG. 8, and advantageously, the standoffs 702 of FIG. 7 are constructed so that one or more individual supports 802*a*, 802*b*, 804*a*, 804*b* (e.g., rings, bars or strips (of, for example, circular, oval, square, rectangular, triangular, etc., solid or hollow, cross section)) can be connected to them. More particularly, FIG. 8 illustratively shows alternative arc-shaped supports 802*a*, 802*b*, 804*a*, 804*b* that can be attached to the event light 700 via the standoffs 702. In addition, as shown, the arc-shaped supports 802*a*, 802*b* are paired so that, if both are connected a complete ring about the event light 700 is formed, whereas, if the other shown pair of arc-shaped supports 804*a*, 804*b* are used by themselves, a semicircle or two quarter circles will be present, likewise, one semicircle support 802*a*, 802*b* and one or both quarter circle supports 804*a*, 804*b*, alternatively can be used to respectively create a ¾ arc or full circle about the lighting head 708. As noted above, the supports need not be arc-shaped, they can be straight or have other shapes.

FIG. 9 illustrates, in simplified form, the event light 700 of FIGS. 7-8 after attachment of the arc-shaped supports 802*a*, 802*b* of FIG. 8. Depending upon the particular implementation, supports can be electrically conductive (in whole or part) so that they can be part of the conduit for power to lighting blades, but they need not be. Whether or not conductive, the supports are of a material and dimensioned such that they can mechanically support the weight of however many lighting blades can be attached to them.

FIG. 10 illustrates, in simplified form, a set 1000 of alternative lighting blades 1002 that contain multiple individual lighting elements 110 along their length (as shown, a total of 90 lighting elements 110). These lighting blades 1002 each include connectors 1004 on one end that are used to establish a mechanical connection (and optionally an electrical connection) between a standoff/support and the lighting blade 1002.

Figure 11:
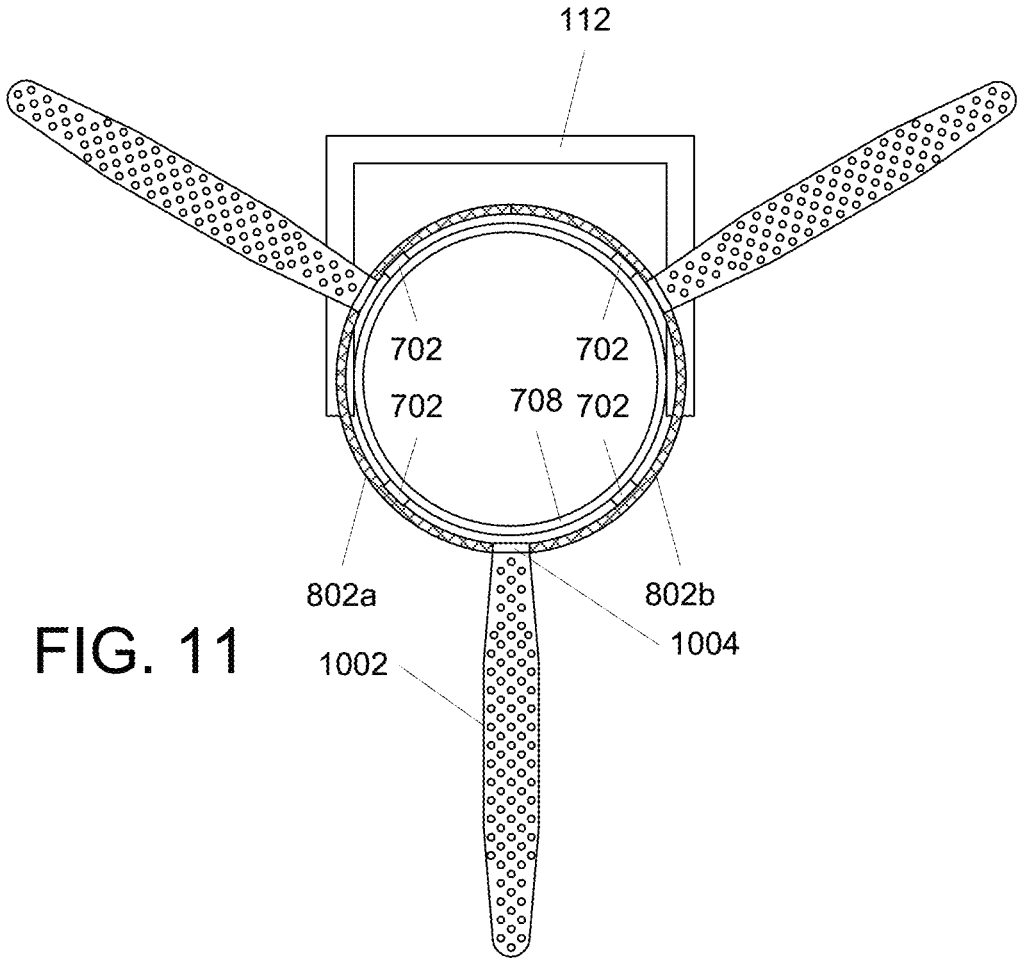
FIG. 11 illustrates, in simplified form, the event light of FIG. 9 after connection of three lighting blades of FIG. 10 in an evenly spaced arrangement.

FIG. 11 illustrates, in simplified form, the event light of FIG. 9 after connection of three lighting blades 1002 of FIG. 10 in an evenly spaced arrangement.

Now, depending upon the particular implementation of the standoff(s) 702, different approaches to connection of lighting blades to the event light can be used. For example, a plug/socket type arrangement on a standoff can be used to provide electrical power from a source to a lighting blade, while a mechanical connection that holds the lighting in place is provided in a different manner. Another alternative example approach is to use a mechanical fastener of some sort to connect the lighting blade to a standoff, with electrical power being supplied to the lighting blade by one or more wires that do not implicate the standoff. With yet another alternative example approach, an electrical connection can be made via a standoff, whereas a mechanical connection can be made via an element other than directly to a standoff. With a still further alternative example approach, neither the electrical nor mechanical connections will be directly provided by any standoff. It will be appreciated that these are just a few examples of the numerous different ways that a mechanical and/or electrical connection between a lighting blade and event light, other permutations and combinations of the foregoing can be created as well, as can other approaches, the important aspect being providing suitable connection to the lighting blades so that they can accomplish the purpose(s) evident from the description herein, not the particular one of the myriad possibilities that is used.

FIGS. 12-15 illustrate, in simplified form, different representative examples of just a few of the myriad connection 1200, 1300, 1400, 1500 possibilities that can be used to provide mechanical and/or electrical connections between a lighting blade and event light in accordance with the teachings herein.

Figure 12:
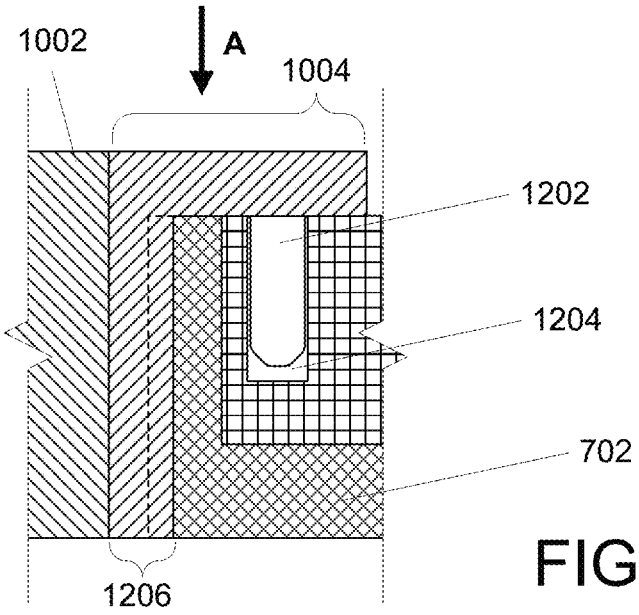

In this regard, FIG. 12 specifically illustrates, in simplified form, one representative possible connection approach 1200. As shown in FIG. 12, the connector 1004 on the lighting blade 1002 includes an electrical plug 1202 that can be inserted into a corresponding electrical socket 1204 to provide an electrical connection to the lighting blade 1002 via a standoff 702 by insertion in the direction designated by the arrow "A." At the same time, mutual interlocking features 1206 of the connector 1004 and standoff 702 are used to form a mechanical connection between the connector 1004 and the standoff 702, by way of non-limiting specific example, through use of a dovetail-dado joint.

Figure 13:
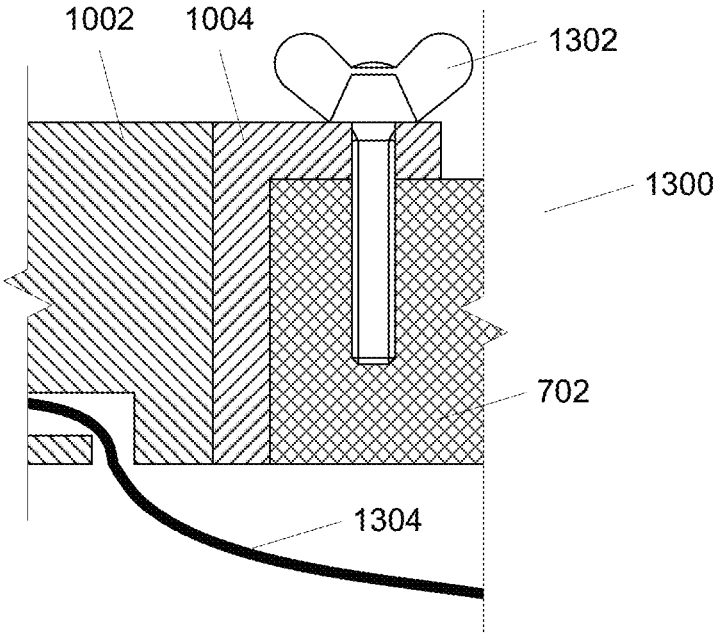

FIG. 13 specifically illustrates, in simplified form, another representative possible connection approach 1300. With the structure of FIG. 13, the connector 1004 of the lighting blade 1002 is mechanically connected to a standoff 702 using any appropriate simple mechanical fastener 1302, such as, for example, a screw, bolt, clip, clamp, cam lock, bolt lock, cotter pin, etc., which, as shown, is a thumb screw (a/k/a butterfly head) bolt. Wiring 1304 that does not involve the standoff at all is used to supply power to the lighting blade 1002 for use by the lighting element(s) 110 (not shown).

Figure 14:
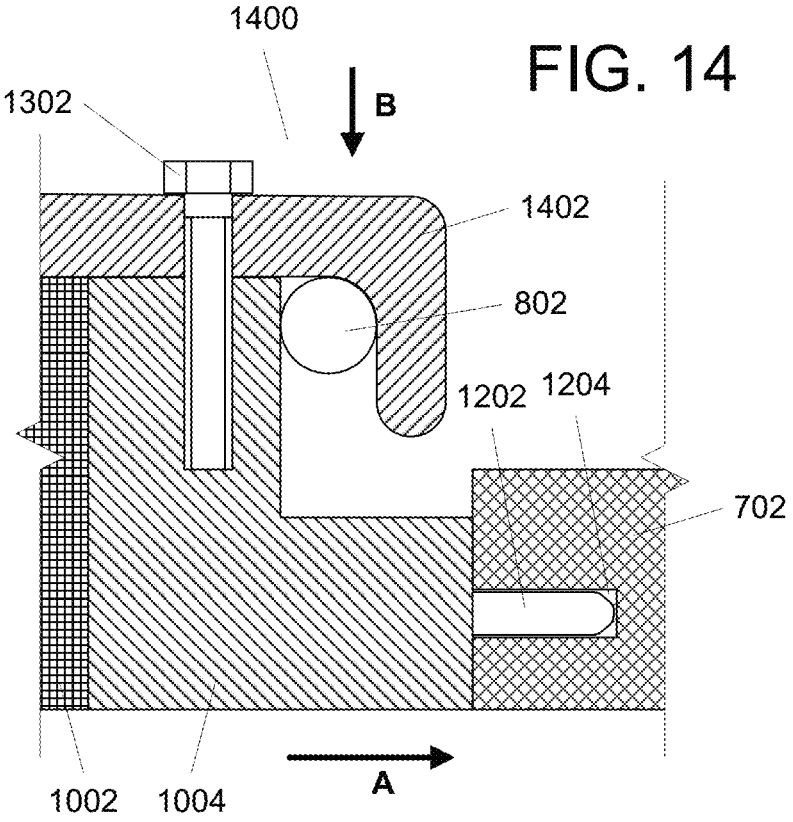

FIG. 14 specifically illustrates, in simplified form, yet another representative possible connection approach 1400. Here, the structure of FIG. 14, includes both at least one standoff 702 and. a support 802 such as described in connection with FIG. 8 (in this specific example, one having a circular cross section). An electrical connection to the lighting blade 1002 via a plug 1202 and socket 1204 connection between the connector 1004 and a standoff 702 through insertion in the direction of arrow "A." In addition, a mechanical connection is established using a cap 1402 that connects with the support 802 by application in the direction of arrow "B" and is held in place by, for example, a mechanical fastener 1302, which, as shown, is a hex head bolt. A further variant of this approach would involve at least part of the support 802 (and possibly the cap) being electrically conductive such that one polarity connection (i.e., power if a DC circuit and a "hot" lead if an AC circuit) with the lighting blade 1002 could be established by connection with the support 802, and the other polarity connection (i.e., ground if a DC circuit and return if an AC circuit) with the lighting blade 1002 could be established by the plug 1202 and socket 1204 connection. Yet a further variant could use the support 802 as either a ground or return connection, or in some cases to supply both polarities or hot/return, and the plug connection could be purely mechanical or provide a path for data and/or any control signals. Another variant could allow the support 802 to be the path for data and/or control signals and the plug 1202/socket 1204 connection being used for power.

FIG. 15 specifically illustrates, in simplified form, a still further representative possible connection approach 1500. In FIG. 15, the standoff 702 plays no direct role in forming a mechanical or electrical connection to a connector 1004 of a lighting blade. Rather, with this variant, that is similar to FIG. 9, there are two supports 802-1, 802-2 that are both electrically conductive (with, for example, each carrying a different polarity) maintained at a distance from the standoff. by, for example, posts 1502, which may be conductive (in whole or part) or non-conductive, depending upon the particular implementation. As shown, the connector 1004 is generally an insulator material, however, a pair of electrical conductive paths 1504-1, 1504-2 run through at least a portion of the connector 1004. In addition, a pair of rigid conductive contacts 1506-1, 1506-2 are used to respectively grab the two supports 802-1, 802-2 and constrain the connector 1004 by capturing them between the rigid conductive contacts 1506-1, 1506-2 and the connector 1004. The rigid conductive contacts 1506-1, 1506-2 are held by an insulated fastening sleeve 1508 and each have a portion that passes through the fastening sleeve 1508 to each couple with one of the electrical conductive paths 1504-1, 1504-2, for example, using a pin and socket 1510 connection approach. A simple mechanical fastener 1302 is used to maintain a solid physical connection between the connector 1004 and supports 802-1, 802-2. Note here that the posts 1502 may be in the vicinity of the connection formed using the rigid conductive contacts 1506-1, 1506-2 or they may be removed from that location.

FIG. 16 illustrates, in simplified form, another example variant collar 1600 for use with an entirely conventional event light without requiring any modification of the event light itself. The collar 1600 of FIG. 16 is dimensioned and sized so as to couple to the event light, for example, by forming a friction fit to the event light with which it will be used, and/or, optionally, the collar 1600 can include one or more tabs or protrusions 1602 with one or more openings/slots 1604 therein that can be used as an anchor for any spring(s) or strap(s) that may be used to attach the collar 1600 to the event light. As shown, this collar 1600 includes two electrically conductive supports 802-1, 802-2 usable to provide power to one or more attached lighting blades and, optionally, includes at least a third support 802-3 for, depending upon the particular implementation, forming a mechanical connection with alighting blade, supplying data and/or control signals to an attached lighting blade. Of course, it is to be understood that the specific placement of the supports 802-1, 802-2, 802-3 and which get used for what purpose will be an implementation detail and is not a critical factor.

Each support 802-1, 802-2, 802-3 (if present) includes a terminal 1606 that is used as an electrical connection point. The terminals 1606 are typically, but not necessarily, brought together at a junction or connector 1608 for neatness and/or compactness so that a single wire 1610 (or wire bundle) can be used to form a connection between the terminals 1606 of the supports 802-1, 802-2, 802-3 and a power source 1612 and (optionally) a data source 1614. Depending upon the particular implementation, the wire 1610 can have connectors on both ends, so that it can be detached from the collar 1600 and the power source 1614 (and optional data source 1614) for transport. Alternatively, the wire 1610 can be solidly connected to the collar 1600 and can simply be coiled for transport with the collar 1600.

Up to now, the lighting blades described herein have all included one or more lighting elements 110, however, advantageously, that is not necessarily a requirement. In some cases, the lighting blades can act as extensions for other sized, or shaped, lighting blades that will be coupled to the event light via such extensions. In this manner, different removable lighting blades can be used with a common set of extensions.

Figure 17A:
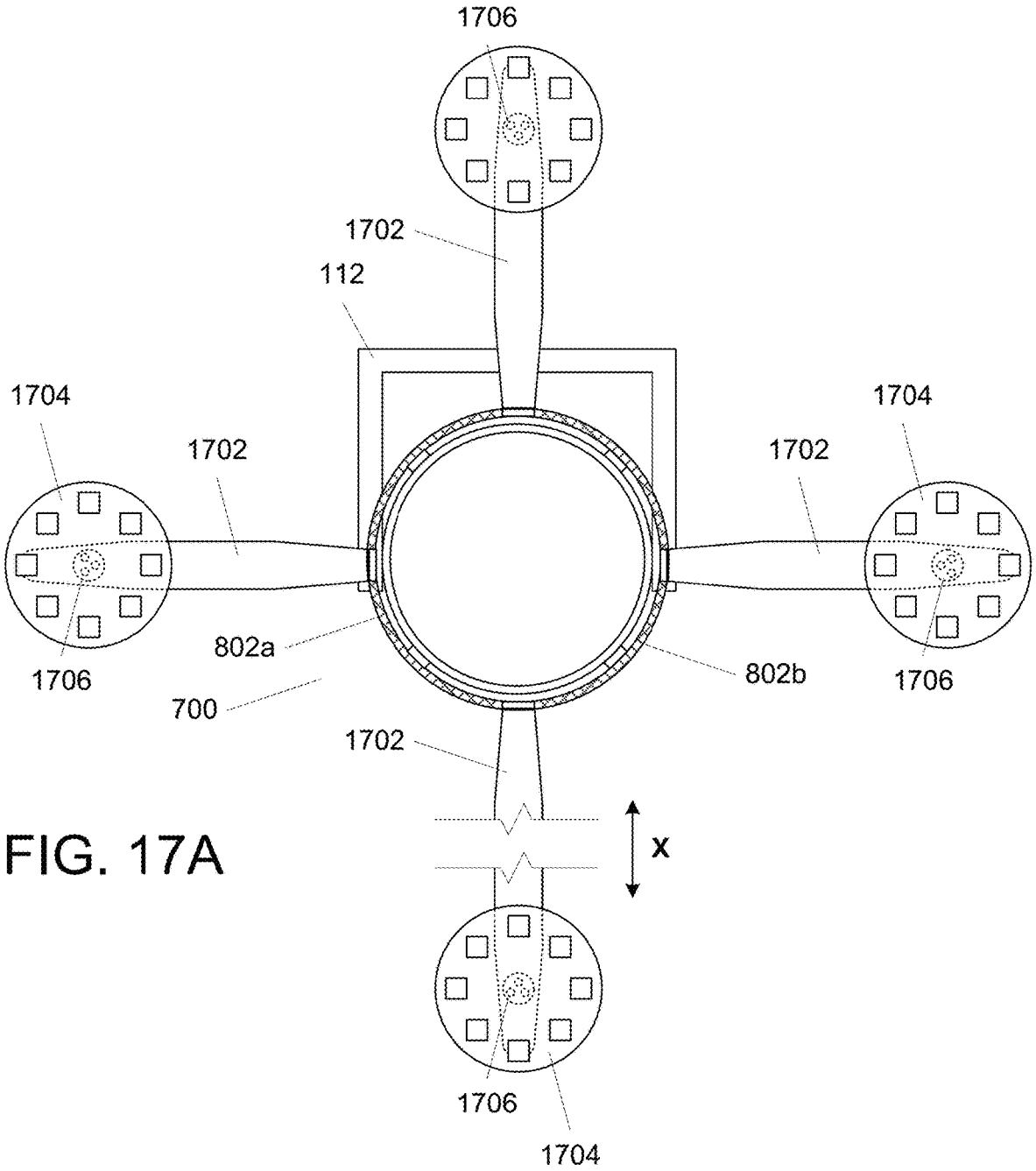
FIG. 17A illustrates, in simplified form, of the event light of FIG. 7 to which four lighting blades having no lighting elements thereon, act as extensions for a further set of removable lighting blades to situate those lighting blades at a distance away from the event light.

FIG. 17A illustrates, in simplified form, of the event light 700 of FIG. 7 to which four lighting blades 1702, having no lighting elements thereon, act as extensions for a further set of removable lighting blades 1704 (containing lighting elements 110) to situate those lighting blades 1704 at a distance away from the event light 700. As shown, one of the extender lighting blades 1702 is made up of, for example, telescoping portions. This will enable an extender lighting blade 1702 to be lengthened and/or shortened (i.e., extended and/or retracted) in a longitudinal direction as shown by the arrow "X" of FIG. 17.

One part of a mating electrical connector 1706 is located on each of the lighting blades 1704 and extender lighting blades 1702 so that power (and optionally control signals and/or data) can be provided to the lighting blades 1704 via wiring (not shown) passing through the extender lighting blades 1702.

Figure 17B:
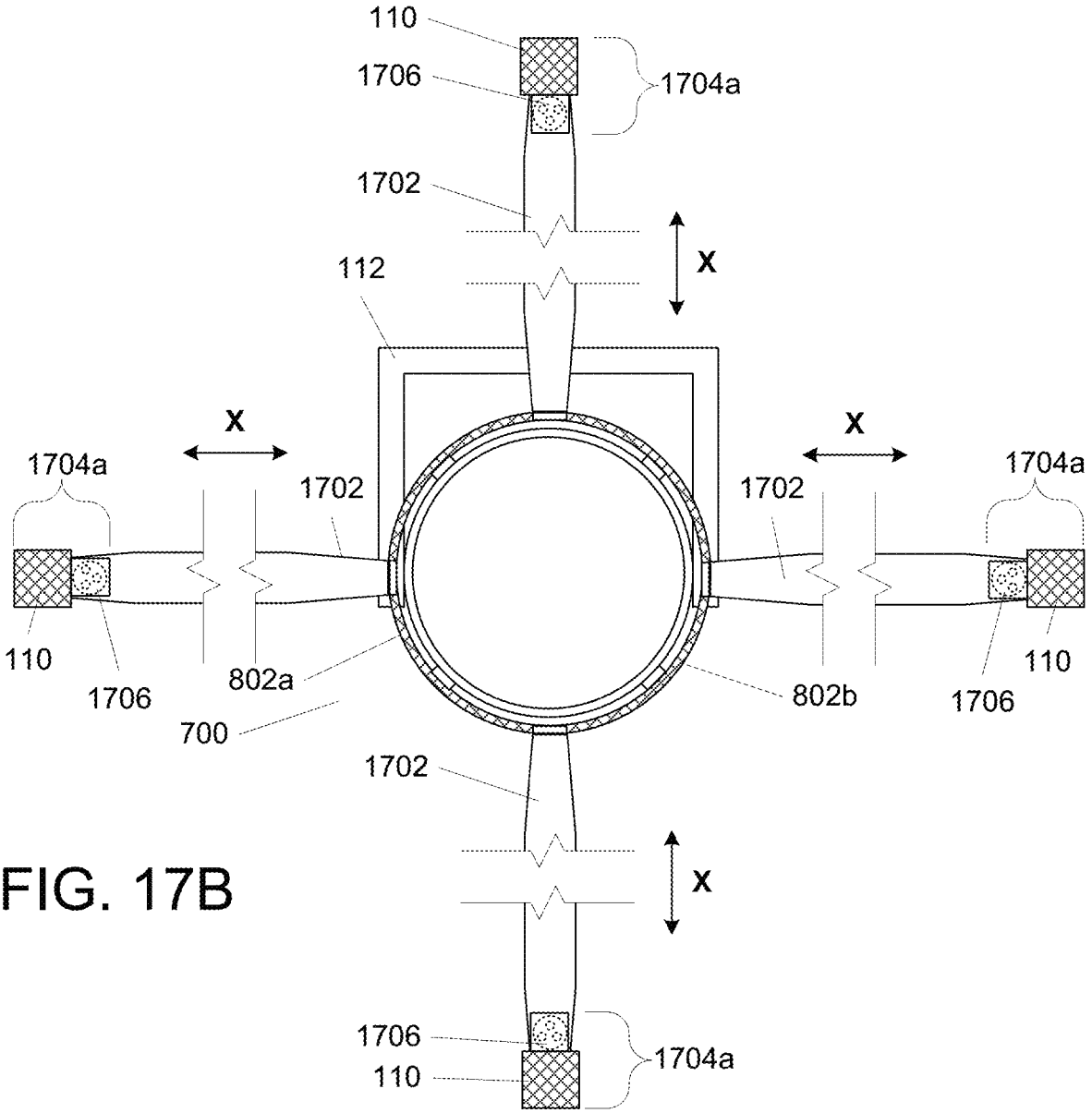
FIG. 17B illustrates, in simplified form, the event light 700 of FIG. 7 to which multiple extender lighting blades 1702 have been attached.

FIG. 17B illustrates, in simplified form, the event light 700 of FIG. 7 to which multiple extender lighting blades 1702 have been attached. In addition, alternative removable lighting blades 1704*a* have been attached. As shown these removable lighting blades 1704*a* are constructed to matingly connect via the same electrical connector 1706 as in FIG. 17A, however, the alternative removable lighting blades 1704*a* each have a single lighting element 110.

Of course, as noted above, for all implementations employing the teachings herein, if data and/or control signals are to be supplied, they can alternatively be provided wirelessly, in which case, only wiring from the wireless receiver to the lighting elements 110 will be needed.

Moreover, in some cases, a lighting blade as described herein, containing lighting elements 110, can also be constructed so that it can be longitudinally extended and/or retracted similar to the extender lighting blade described above. In this manner, its terminal end can be moved relative to the event light body in a longitudinal direction, irrespective of any pivotal motion that may, or may not, be possible with the particular implementation.

Now, in some cases, it may not be possible or feasible for some reason to replace a given conventional event light, of the type having tabs, clips, frames or similar components (i.e., supports of a type conventionally used to accept other auxiliary components, for example, gels, color frames, irises, "barn doors," etc.), but there may still be a desire to make use of improvements such as described in the teachings herein. Advantageously, variants of our approach can be used with such conventional event lighting.

Figure 18:
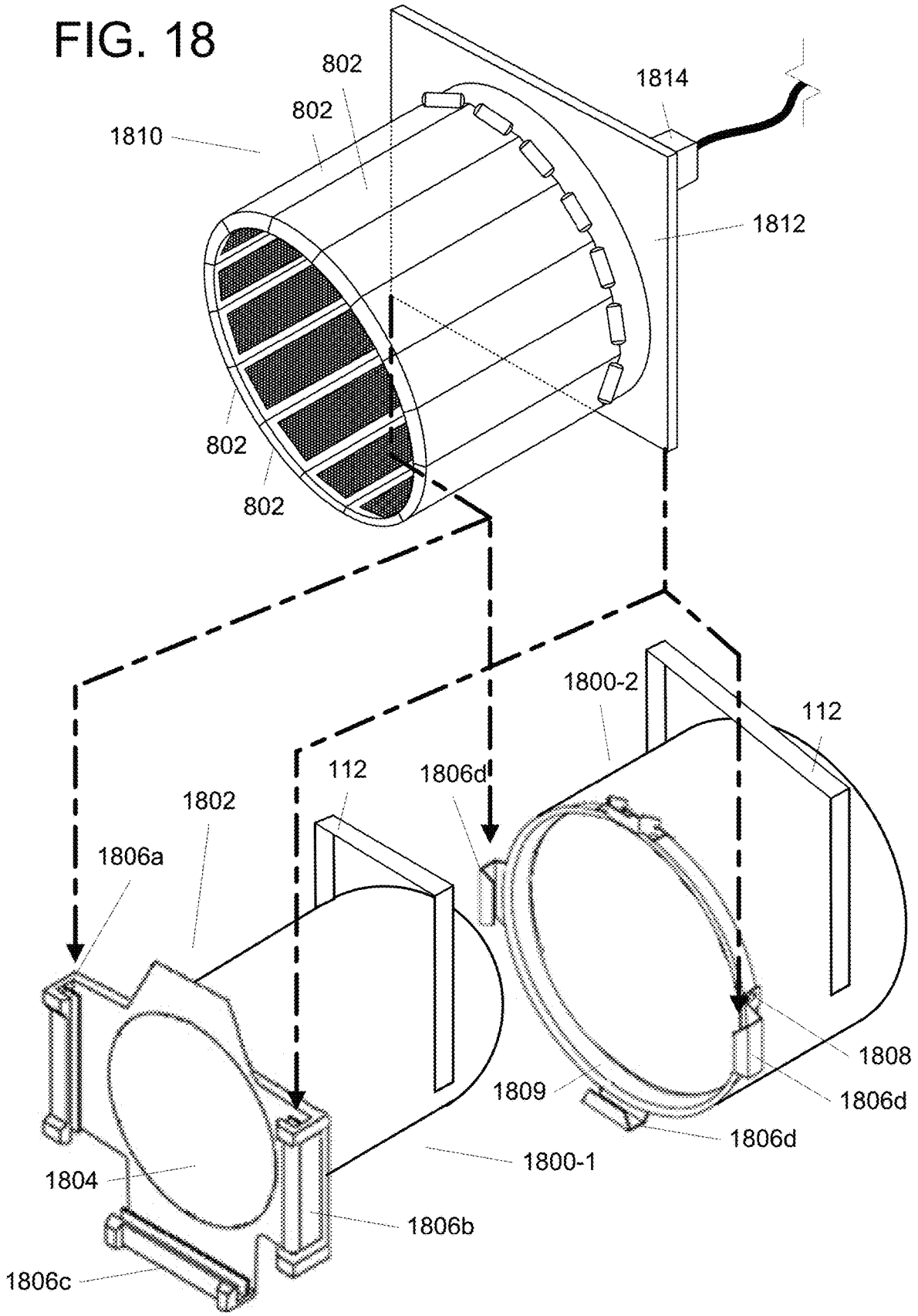
FIG. 18 illustrates, in simplified form, two well known style conventional event lights and how the teachings herein can be used up augment or upgrade such conventional lights.

FIG. 18 illustrates, in simplified form, two well known style conventional event lights 1800-1, 1800-2 and how the teachings herein can be used up augment or upgrade such conventional lights. As shown, the event lights 1800-1, 1800-2 have located near their fronts, conventional supports of the type conventionally used to accept other auxiliary components, for example, gels, color frames, irises, "barn doors," etc. More specifically, one of the event lights 1800-1 includes a cast or molded frame 1802 that surrounds the lighting element(s) 1804 and includes three slotted supports 1806*a*, 1806*b*, 1806*c*, whereas the other event light 1800-2 includes three stamped metal supports 1806*d* that are attached by rivets 1808 (only one of which is shown) to a front part 1809 of the event light 1800-2.

Advantageously, by use of, for example, a blade collar 1810 that is similar to the blade collar 402 of FIG. 4, but further includes a flange 1812 that is sized and shaped similar to the periphery of one of the conventional auxiliary components normally available for such event lights 1800-1, 1800-2, the additional lighting blades 408 can now be used as another auxiliary component for either event light 1800-1, 1800-2 through insertion in the same manner (as indicated by the long-short dashed lines) as those conventional components. The flange 1812 of the blade collar 1810 may contain wiring necessary to provide at least power (and possibly data signals) to the lighting blades 408 and may also optionally contain more sophisticated control circuitry that can allow the lighting blades 408 to provide different effects. Moreover, such a blade collar 1810 will typically be entirely independent of the event light 1800-1, 1800-2 itself, in that it will have a plug/receptacle 1814 via which it can receive power from a power source (not shown).

Of course, it is to be understood that the shape of a given blade collar can vary, the only requirement being the ability of its flange to slot into the conventional supports of the particular event light(s) with which it would be used.

In some further cases, it may be desirable to be able to use removable lighting blades such as described herein with such conventional event lights. Advantageously, this can be accomplished as well through using the teachings described herein.

Figure 19:
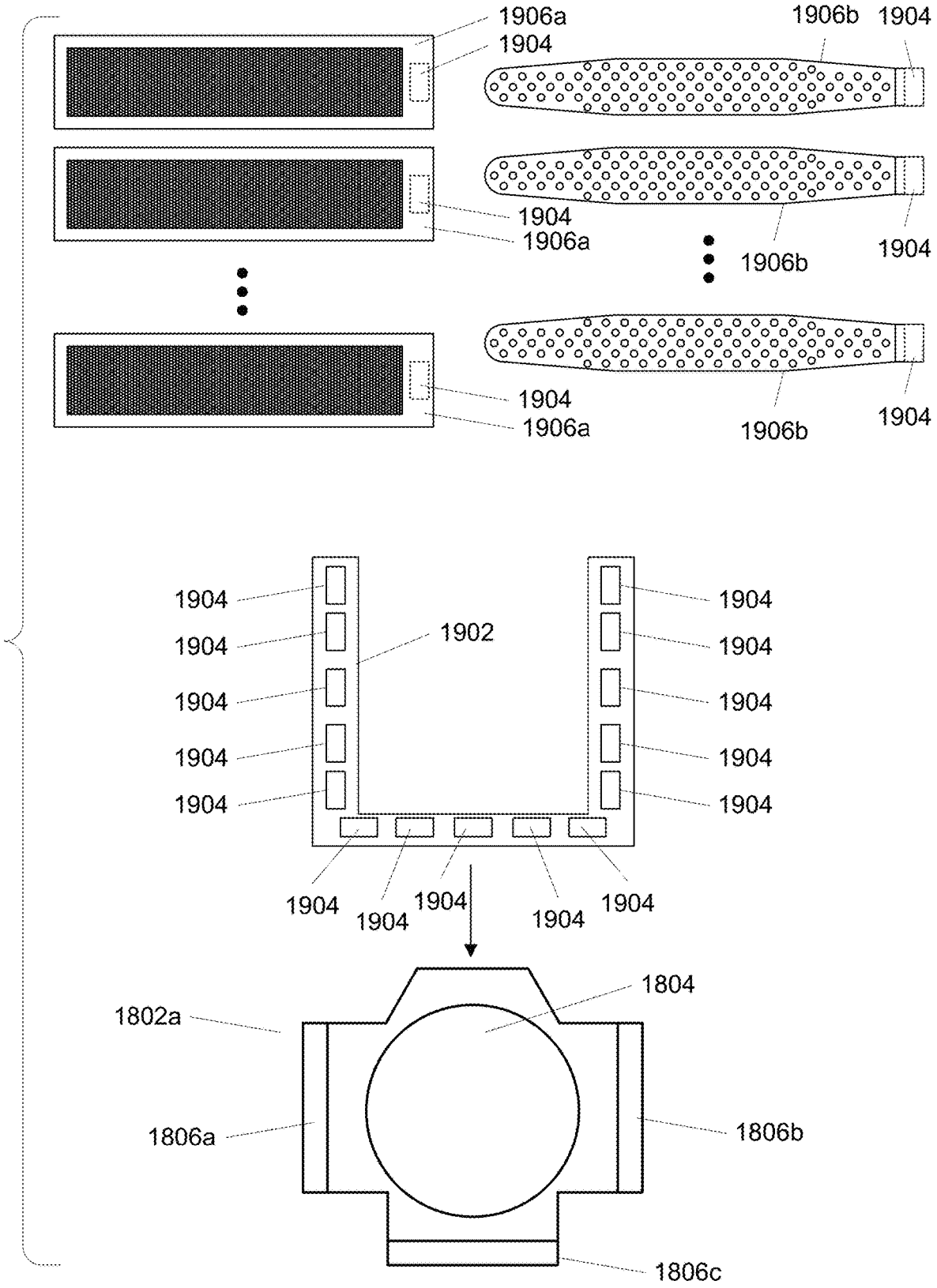
FIG. 19 illustrates, in simplified form, a front view of some example components that provide for use of removable lighting blades with conventional event lights such as described in connection with FIG. 18.

FIG. 19 illustrates, in simplified form, a front view of some example components that provide for use of removable lighting blades with conventional event lights such as described in connection with FIG. 18. For simplicity, this approach will be described with reference to the cast or molded frame 1802 of one event light 1800-1 of FIG. 18 (with only the cast or molded frame 1802 being shown), with the understanding that the same approach can be used with any such event light. As shown, we use an auxiliary component 1902 that has an outer periphery shaped and sized to (at least in part) fit into the slotted supports 1806*a*, 1806*b*, 1806*c*. As shown, the auxiliary component 1902 further includes multiple connectors 1904 that can be used to supply power (and possibly data signals) when a mating connector of a lighting blade is attached and to allow for different configuration(s) of such lighting blades. The auxiliary component 1902 contains internal wiring (not shown) to enable such power (and potentially data signals) to be conveyed from a source (not shown) to the lighting blades. In this manner, alternative lighting blades 1906*a*, 1906*b* can be attached to the auxiliary component 1902 via their correspondingly mating connectors 1904.

Figure 20:
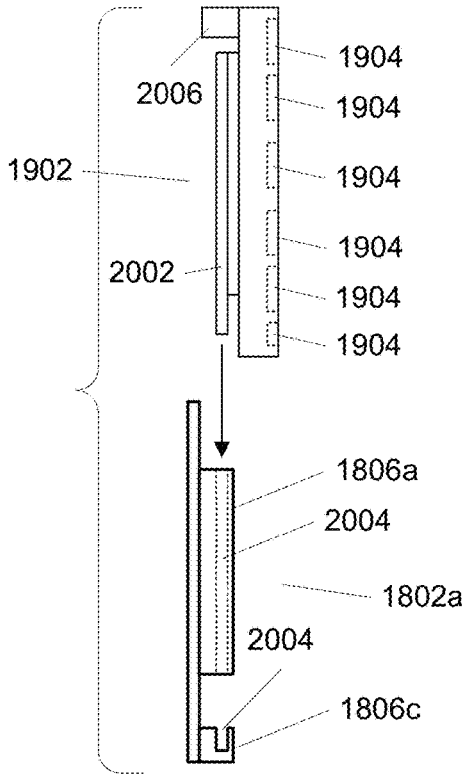
FIG. 20 illustrates, in simplified form, a side view of the cast or molded frame of FIGS. 18-19 along with a side view of the auxiliary component of FIG. 19 to show how one slots into the other.

FIG. 20 illustrates, in simplified form, a side view of the cast or molded frame 1802 of FIGS. 18-19 along with a side view of the auxiliary component 1902 of FIG. 19 to show how one slots into the other.

As shown, the auxiliary component 1902 includes a flange 2002 that is sized to correspond to the slot 2004 of the slotted support 1806*c*. In this manner, the auxiliary component 1902 will be held and constrained by the slotted supports 1806*a*, 1806*b*,1806*c*. In addition, as can be seen in this view, the auxiliary component 1902 includes a connector 2006 to which at least a power cable (not shown) can be connected to provide power for use by any lighting blades that may be connected via the connectors 1904.

Optionally, and alternatively, variants of the auxiliary component of FIGS. 19-20 can be constructed such that, there are one or more lighting elements 110 in the location of, and in place of, one or more of the connectors 1904. In this manner, the auxiliary component becomes an augmenting light for the event light. Moreover, the size and shape of the auxiliary component in such a case can be of any shape, although in most cases, it will be desired to provide an aperture so that the beam of the event light can project through it without impacting the primary purpose of the event light. However, in some cases, a particular auxiliary component can be made to advantageously be used entirely in place of the event light's primary light source, while attaching to the event light. In such a case, there would be no need for any type of aperture.

Figure 21:
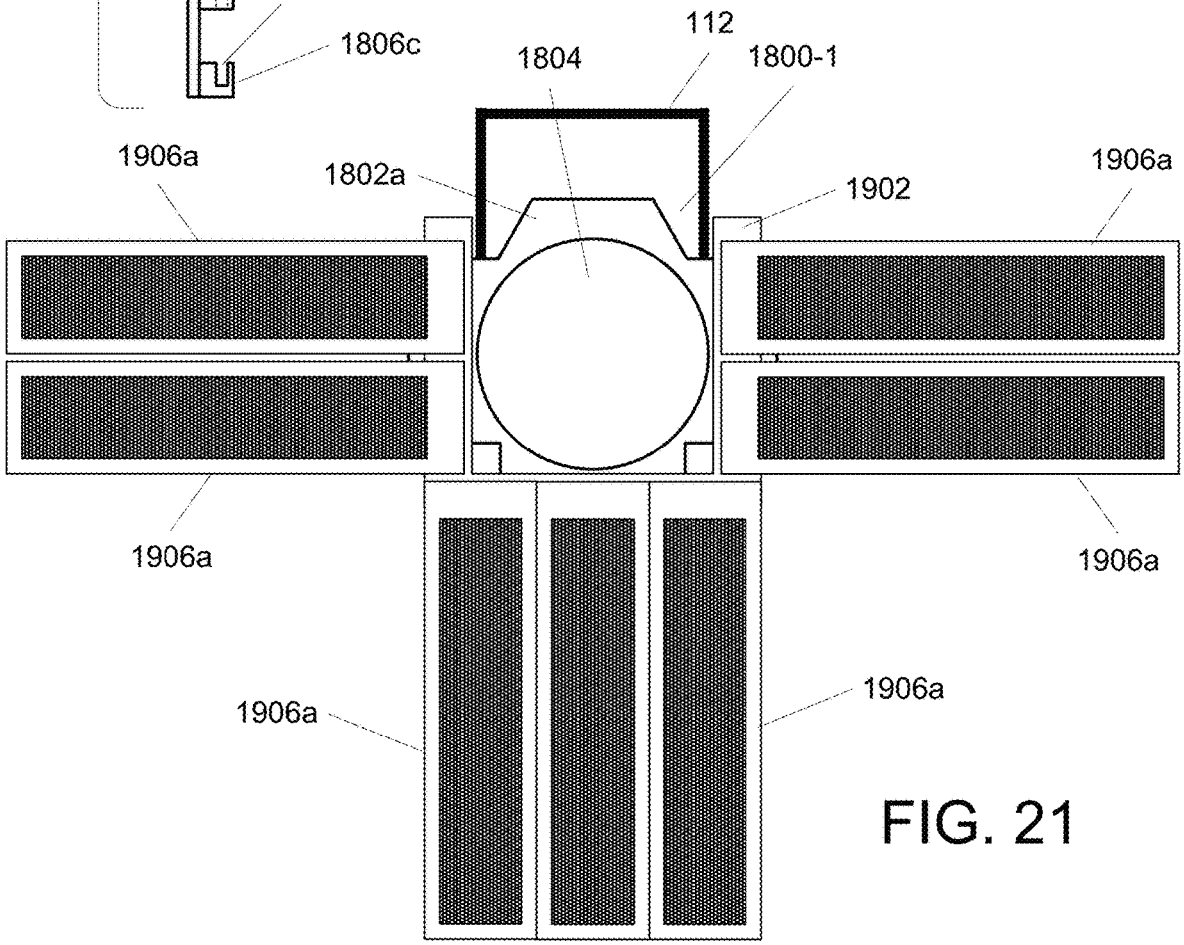
FIG. 21 illustrates, in simplified form, a front view of an the event light that has received an auxiliary component with multiple lighting blades connected to it.

FIG. 21 illustrates, in simplified form, a front view of an the event light 1800-1 that has received an auxiliary component 1902 with multiple lighting blades 1906*a* connected to it, as shown, in a configuration that is symmetrical about the vertical axis but asymmetrical about the horizontal axis.

As an alternative, in some cases, it may be desirable to be able to connect a lighting blade directly to a support, such as any of supports 1806*a*, 1806*b*, 1806*c*, 1806*d*.

Figure 22:
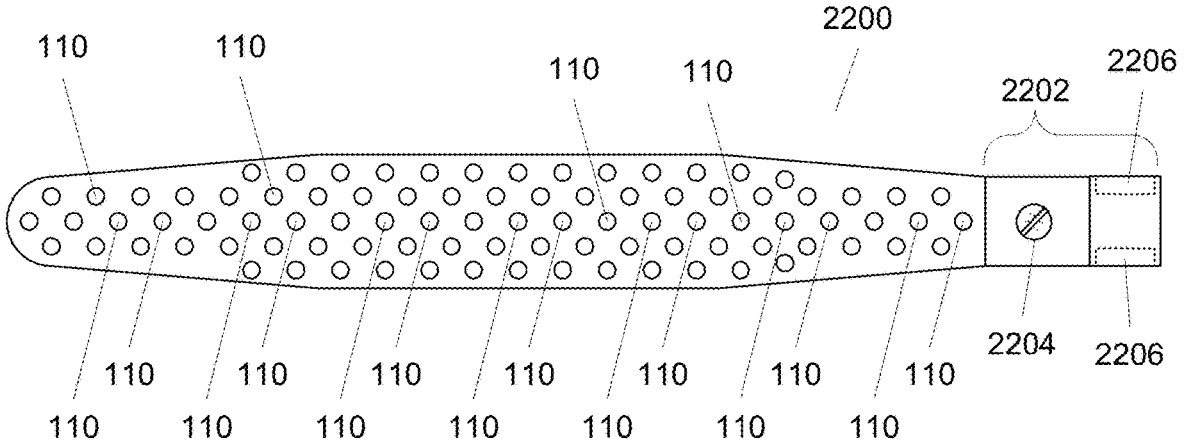
FIG. 22 illustrates, in simplified form, one example of a lighting blade of a type that can directly connect to a support of a conventional event light.

FIG. 22 illustrates, in simplified form, one example of a lighting blade 2200 of a type that can directly connect to a support 1806*a*, 1806*b*, 1806*c*, 1806*d* of a conventional event light. As shown, the lighting blade 2200 includes multiple lighting elements 110 as described previously. The lighting blade 2200 also includes a connection portion 2202 which is used to form a physical connection with the desired support 1806*a*, 1806*b*, 1806*c*, 1806*d* and includes wiring and circuitry necessary to receive power (and potentially data).

More specifically, the connection portion 2202 includes a component to physically lock the lighting blade 2200 to the desired support 1806*a*, 1806*b*, 1806*c*, 1806*d*, for example, using any conventional component such as, a clip, set screw, clamp, etc. As shown in FIG. 22, a slotted head set screw 2204 is used. In addition, the connection portion 2202 also includes one (or optionally more) connector(s) 2206 that provide a connection point for a power cable (not shown) and potentially a data signal connection as well. Advantageously, with some variants, where there are more than one connector, the connectors 2206 can be set up so that the lighting blade can be connected to one or more other lighting blades (for power and/or data) in, for example, a "daisy chain" or "hub and spoke" fashion.

Figure 23:
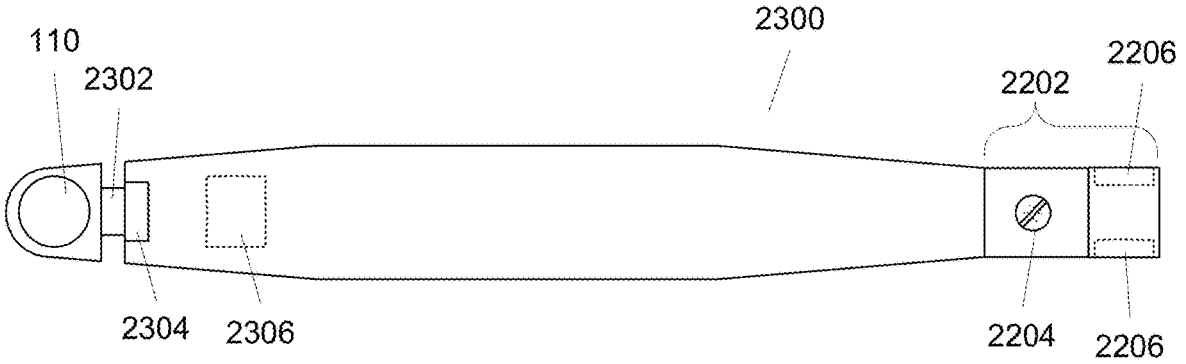
FIG. 23 illustrates, in simplified form, an alternative example lighting blade of a type that can directly connect to a support of a conventional event light.

FIG. 23 illustrates, in simplified form, an alternative example lighting blade 2300 of a type that can directly connect to a support 1806*a*, 1806*b*, 1806*c*, 1806*d* of a conventional event light. As shown, the lighting blade 2300 is similar to the lighting blade 2200 of FIG. 22 except that it includes a single lighting element 110 that is coupled to the rest of the lighting blade 2300 by a swivel 2302 connection and a pivot 2304 connection, which are coupled for movement using, for example, one or more gear(s), solenoid(s), actuator(s), cable(s) or other movement elements, under control of control circuitry 2306 in order to allow the lighting element 110 be moved rotationally about an axis coincident with, or parallel to, the longitudinal axis of the lighting blade 2300 via the swivel 2302 and/or pivotally (i.e., into or out of a plane coincident with, or parallel to, a plane defined by the lighting elements 110) via the pivot 2304 during use, if desired.

FIG. 24 illustrates, in simplified form, a side view of the example lighting blade 2200 of FIG. 22 coupled directly to an example support 1806*a* of the event light 1800-1 of FIG. 18. As shown in FIG. 24, the connection portion 2202 includes a flange 2402 that slots into part of the support 1806*a*. The lighting blade 2200 is then locked into place, for the lighting blade 2200 shown, by tightening the set screw 2204.

FIG. 25 illustrates, in simplified form, a side view of the example lighting blade 2200 of FIG. 22 coupled directly to an example support 1806*d* of the event light 1800-2 of FIG. 18 in an equivalent manner to what is shown in FIG. 24.

It should now be recognized that, for different variant implementations, the supports 1806*a*, 1806*b*, 1806*c*, 1806*d* can serve as the shelf 412 of FIGS. 4A-4C, part of the block 502 of FIGS. 5A-5B, or the standoffs 702 of any of FIGS. 7-9, 11-16 and 17A-17B.

Figure 26:
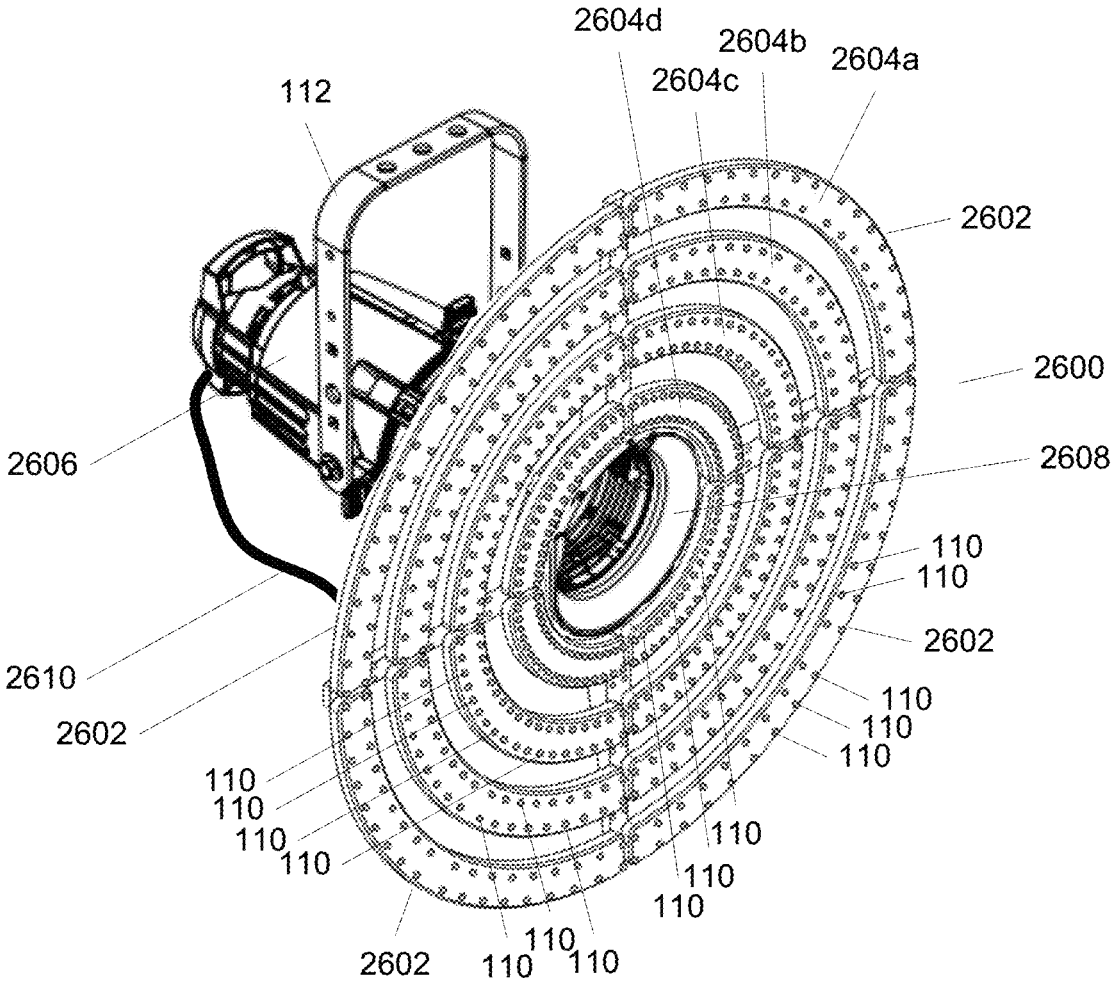
FIG. 26 illustrates, in simplified form, another example alternative variant of an auxiliary component made up of multiple lighting blades, each having four quarter circle segments that each contain multiple lighting elements.

FIG. 26 illustrates, in simplified form, another example alternative variant of an auxiliary component 2600 made up of multiple lighting blades 2602, each having four quarter circle segments 2604*a*, 2604*b*, 2604*c*, 2604*d* that each contain multiple lighting elements 110. The auxiliary component 2600 attaches to the supports on the front of an event light 2606, for example, via the frame 1802 (and its associated supports 1806*a*, 1806*b*, 1806*c*) of the conventional event light 1800-1 of FIG. 18 or the supports 1806*d* of the conventional event light 1800-2 of FIG. 18, via a flange (not shown in this view) as described in connection with FIGS. 18-20. As shown, the auxiliary component 2600 includes an aperture 2608 in the center to allow the event light to function normally and project through the center of the auxiliary component 2600. In addition, as shown, the auxiliary component 2600 includes a wire 2610 that allows it to obtain power by plugging into an outlet on the event light 2606, although, alternatively, the wire 2610 could be used to obtain power from an alternative source (i.e., independent of the event light itself).

FIG. 27 illustrates, in simplified form, yet another example alternative variant of an auxiliary component 2700 coupled to the conventional event light of FIG. 26. As shown, this auxiliary component 2700 is a single piece that acts as a lighting blade and has an array of lighting elements 110 (denoted by cross hatching) spanning most of its surface. As with FIG. 26, this auxiliary component 2700 attaches via a flange (not shown in this view) and similarly includes an aperture 2608 so that the event light 2606 can project through the center of the auxiliary component 2700.

FIG. 28 illustrates, in simplified form, yet another example alternative variant of an auxiliary component 2800 coupled to the conventional event light of FIG. 26. As shown, and as in FIG. 27, the auxiliary component 2800 of FIG. 28 is also a single piece that acts as a lighting blade and contains an array of lighting elements 110. Depending upon the particular lighting elements 110 used, the auxiliary component 2800 could operate as a single large spotlight, as a video screen, or to project in a controlled pattern based upon selectively using individual lighting elements 110 making up an array. However, unlike with the prior auxiliary components 2600, 2700 of FIGS. 26-27, the auxiliary component 2800 of FIG. 28 does not include an aperture. This is because the auxiliary component 2800 of FIG. 28 is intended to supplant, rather than augment, the lighting capability of the event light to which it is attached. Accordingly, as shown, the wire 2610 is used to obtain power from a source other than the event light itself.

Having described and illustrated the principles of this application by reference to one or more example embodiments, it should be apparent that the embodiment(s) may be modified in arrangement and detail without departing from the principles disclosed herein and that it is intended that the application be construed as including all such modifications and variations insofar as they come within the spirit and scope of the subject matter disclosed.

What is claimed is:

1. An auxiliary component for use with event lighting comprising:

a collar, dimensioned to removably couple to an event light having an external surface;

at least one lighting blade, having at least one lighting element thereon, removably coupled to the collar; and a path for power to be transferred from an external power source to the at least one lighting element of the at least one lighting blade.

2. The auxiliary component of claim 1, wherein the event light has at least one support positioned between the collar and the event light when the collar is coupled to the event light.

3. The auxiliary component of claim 2, wherein the at least one support is at least one of a ring bar or strip.

4. The auxiliary component of claim 2, wherein the at least one support has at least one of a circular, oval, square, triangular, or rectangular cross section.

5. The auxiliary component of claim 1, wherein the at least one lighting blade is physically and electrically coupled to the collar by mating connectors.

6. The auxiliary component of claim 1, wherein the at least one lighting blade includes multiple lighting elements thereon.

7. The auxiliary component of claim 6 further comprising a second lighting blade coupled to the at least one support via the extension lighting blade.

8. The auxiliary component of claim 2, wherein the at least one support is made up of at least two segments.

9. The auxiliary component of claim 1, wherein the at least one support forms a closed path about the event light.

10. An auxiliary component for use with event lighting comprising:

a collar, dimensioned to couple to an event light having an external surface;

wherein the collar comprises a sleeve, connectors that can matingly receive a corresponding connector on a terminal end of individual lighting blades, and at least one lighting blade removably coupled to one of the connectors via its terminal end, the at least one lighting blade having at least one lighting element thereon; and wherein the at least one lighting blade is movable relative to the sleeve such that the at least one lighting blade can moved between a stowed position and a deployed position.

11. The auxiliary component of claim 10, wherein the at least one lighting blade is pivotably movable until it reaches a lock position.

12. The auxiliary component of claim 10, wherein the at least one lighting blade is pivotably movable through multiple alternative lock positions.

13. The auxiliary component of claim 10, further comprising a power connection via which the at least one lighting blade can obtain power from the event light.

14. The auxiliary component of claim 10, further comprising a power connection via which the at least one lighting blade can obtain power from an external power source independent of the event light.

15. The auxiliary component of claim 10, wherein the collar further comprises a flange dimensioned to couple to the event light via a support of the event light that is coupled to the external surface.

16. An event light comprising:

a body having an external surface, the external surface comprising a forward external surface and a side external surface, and at least one light source defining a forward portion of the body;

a yoke coupled to the side external surface of the body; and at least one lighting blade having at least one lighting element associated therewith, the at least one lighting blade being removably coupled to one of the forward external surface or the side external surface of the body.

17. The event light of claim 16, wherein the at least one lighting blade is movable relative to the body such that the lighting blade can be moved between a stowed position and a deployed position.

18. The event light of claim 16, wherein the at least one lighting blade is removably coupled to the body via a standoff that is part of the body.

19. The event light of claim 18, wherein the standoff serves as a depth stop for a sleeve containing the multiple lighting blades.

20. The event light of claim 18, wherein the standoff includes an electrical connector through which power can be supplied to the at least one lighting blade.

21. The event light of claim 16, further comprising a flange via which the at least one lighting blade is coupled to the forward portion of the body.

22. The event light of claim 16, wherein the at least one lighting element is movable relative to the lighting blade with which it is associated.

23. The event light of claim 16, wherein the at least one lighting element includes an aperture through which the at least one light source can project light.

* * * * *